US008042911B2

(12) United States Patent
Sasaki

(10) Patent No.: US 8,042,911 B2
(45) Date of Patent: Oct. 25, 2011

(54) LIQUID DISPENSER HEAD, LIQUID DISPENSING UNIT USING SAME, AND IMAGE FORMING APPARATUS USING SAME

(75) Inventor: Takafumi Sasaki, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 455 days.

(21) Appl. No.: 11/936,922

(22) Filed: Nov. 8, 2007

(65) Prior Publication Data

US 2008/0111862 A1 May 15, 2008

(30) Foreign Application Priority Data

Nov. 10, 2006 (JP) ..... 2006-305395
Oct. 12, 2007 (JP) ..... 2007-266977

(51) Int. Cl.
*B41J 2/04* (2006.01)
*B41J 2/045* (2006.01)

(52) U.S. Cl. ..... 347/54; 347/70

(58) Field of Classification Search ..... 347/69–70
See application file for complete search history.

(56) References Cited

U.S. PATENT DOCUMENTS 4,525,728 A * 6/1985 Koto ..... 347/70
2004/0079768 A1* 4/2004 Kiguchi ..... 222/420

FOREIGN PATENT DOCUMENTS

JP 7-156387 * 6/1995
JP 2001-293865 * 10/2001
JP 2002-205392 * 7/2002
JP 2002-301819 * 10/2002
JP 2002-347249 * 12/2002
JP 2003-266683 * 9/2003
JP 2004-74806 * 3/2004
JP 3687481 * 6/2005

* cited by examiner

*Primary Examiner* — Matthew Luu
*Assistant Examiner* — Lisa Solomon
(74) *Attorney, Agent, or Firm* — Cooper & Dunham LLP

(57) ABSTRACT

A liquid dispenser head includes nozzles, pressure chambers, an energy generator, a shared chamber, a vibration member, and a specific wall portion. The nozzles discharge liquid. Each of the pressure chambers communicates with a corresponding one of the nozzles. The energy generator, provided for each of the pressure chambers, generates energy for pressurizing liquid in the pressure chamber. The shared chamber supplies liquid to the pressure chambers. The vibration member, forming a wall of each one of the pressure chambers, includes an energy-transmitting area configured to transmit the energy generated by the energy generator to each one of the pressure chambers. The specific wall portion, constituting at least a part of the same wall, or a different wall, of each of the pressure chambers, has a structural compliance set greater than a compression compliance of liquid in the pressure chamber.

18 Claims, 15 Drawing Sheets

LIQUID DISPENSER HEAD, LIQUID DISPENSING UNIT USING SAME, AND IMAGE FORMING APPARATUS USING SAME

TECHNICAL FIELD

The present disclosure relates generally to a liquid dispenser head, a liquid dispensing unit having a liquid dispenser head, and an image forming apparatus having a liquid dispenser head.

DESCRIPTION OF THE BACKGROUND ART

In general, an image forming apparatus is available as a printer, a facsimile machine, a copier, a plotter, or a multifunctional apparatus having multiple functions thereof. Such image forming apparatus may include a liquid dispensing unit having a liquid dispensing head (or a recording head) for dispensing droplets of recording liquid onto a recording sheet to form an image on the recording sheet.

Such sheet includes, but is not limited to, a medium made of material such as paper, string, fiber, cloth, leather, metal, plastic, glass, timber, and ceramic, for example. Further, the term "image formation" used herein refers to providing, recording, printing, or imaging an image, a letter, a figure, or a pattern to a sheet. Moreover, the term "liquid" used herein is not limited to recording liquid or ink but includes anything discharged in fluid form. Hereinafter, the recording liquid is referred to as ink for simplicity of description.

Furthermore, a liquid dispensing unit having a liquid dispenser head can be used in any application area, including, but not limited to, forming an image on a sheet, dispensing liquid for specific purposes (e.g., fabrication of semiconductor), and the like.

Such liquid dispensing unit or image forming apparatus have found industrial applications in such fields as cloth-printing apparatuses and metal wiring devices, while commercial demand for better image quality and faster printing speed continues to grow.

In view of such demand for better image quality, nozzle density, or a number of nozzles per unit area of the liquid dispenser head, continues to increase, narrowing spacing between pressure chambers of a recording head and increasing an energy frequency, or number of vibrations applied to the recording head.

Further, in view of such demand for faster printing speed, a line printer having page-wide arrays (PWA) of recording head has been developed. The main advantage of such PWA head is that it has a length sufficient to print a single line image on a recording medium with a single liquid discharge. However, a drawback of such PWA head is that its manufacture requires consistently high precision to very narrow tolerances.

In general, a recording head or liquid dispenser head includes a nozzle, a liquid chamber communicated to the nozzle, and a pressure generation device to generate pressure for discharging liquid droplets from the nozzle, and a common chamber for supplying liquid to the liquid chamber.

In general, a recording head or liquid dispenser head includes a nozzle, a liquid chamber that communicates with the nozzle, and a pressure generator to generate pressure for discharging liquid droplets from the nozzle.

Such recording head may use known methods for discharging liquid droplets, such as a thermal method, a piezoelectric method, and an electrostatic method. In the thermal method, an electricity-heat conversion element such as a heating resistor is used to cause a film boiling of liquid. In the piezoelectric method, an electricity-mechanical energy conversion element such as a piezoelectric element is used. In the electrostatic method, an electrostatic actuator, which generates electrostatic force, is used.

In such image forming apparatus, an image having higher quality can be produced by enhancing a responsiveness of the pressure chamber with respect to energy (e.g., pressure) applied to the pressure chamber.

Specifically, if a resonance cycle of the pressure chamber can be set shorter, the pressure chamber may response to energy (e.g., pressure) applied to the pressure chamber more efficiently and effectively.

For example, such resonance cycle of the pressure chamber can be set shorter by reducing a size (or volume) of the pressure chamber. However, if the size (or volume) of the pressure chamber is reduced, liquid volume that can be dispensed by a single dispensing operation becomes smaller, which is not preferable for producing an image having higher quality.

If liquid volume dispensed by a single dispensing operation becomes smaller, an amount of liquid droplets, which is required for forming an image having higher quality, may be jetted by increasing a number of nozzles (or density of nozzles) of the recording head or by increasing scanning movement of the recording head in case of a serial image forming process. However, such modification to an image forming process may result into complicated manufacturing processes of a recording head, or decreased productivity (e.g., decreased print speed) due to increased number of scanning movement of the recording head.

Alternatively, in some related arts, a resonance cycle of a pressure chamber may be set shorter by increasing rigidity or stiffness of parts configuring a pressure chamber of a recording head.

In this disclosure, rigidity or stiffness of parts configuring the pressure chamber may be referred with a term of "compliance". In general, "compliance" indicates a volume change of an object (e.g., parts configuring a pressure chamber) per unit pressure applied to the object, and the compliance inversely relates to rigidity or stiffness of the object.

For example, if one object has a lower compliance value, the object has a greater stiffness, which means the object is relatively hard to change its volume when a pressure is applied to the object. On the other hand, if one object has a greater compliance value, the object has a lower stiffness, which means the object is relatively easy to change its volume when a pressure is applied to the object.

Accordingly, in case of related arts, if compliance of parts configuring a pressure chamber can be set to a smaller value, a stiffness of the pressure chamber can be increased, by which a resonance cycle of the pressure chamber can be set shorter.

Generally, background arts have a configuration, which may increase a stiffness of a pressure chamber so that a resonance cycle of the pressure chamber can be set shorter. In other words, compliance of a pressure chamber may have a smaller value in background arts.

In one related art, a structural compliance of parts configuring a pressure chamber is set smaller than a compression compliance of a recording agent (e.g., ink) used for the pressure chamber, wherein the structural compliance indicates a volume change rate of parts configuring the pressure chamber per unit pressure applied, and the compression compliance indicates a volume change rate of the recording agent per unit pressure applied.

By setting the structural compliance of parts configuring the pressure chamber smaller than the compression compliance of the recording agent, a stiffness of the pressure chamber may be increased, by which a resonance cycle of the pressure chamber can be set shorter.

Further, in another related art, a vibration plate, used to apply a pressure to a pressure chamber, may be configured with a plurality of layers (e.g., three layers), in which one layer has a higher rigidity (or smaller compliance) and another layer has a lower rigidity (or greater compliance). The vibration plate may have such configuration so that a layer having smaller rigidity can vibrate by a pressure energy applied to the pressure chamber and a layer having greater rigidity may contribute to set a resonance cycle of the pressure chamber to a shorter time.

Furthermore, in another related art, a compliance of ink "C1" and a compliance of vibration plate "C2" used for a pressure chamber may have a compliance ratio of C2/C1, ranging from 5.4 to 10, for example.

Although the rigidity of a pressure chamber may be increased with above-mentioned methods, such methods may have some drawbacks for a viewpoint of configuration of the pressure chamber.

In general, a pressure chamber may be configured with a metal material having higher rigidity (e.g., Si, SUS, Ni) and a vibration plate, which becomes a wall face of the pressure chamber, wherein the vibration plate has an energy-transmitting area (or portion) for transmitting pressure energy, generated by a pressure generator, to the pressure chamber. Because such energy-transmitting area (or portion) of the vibration plate may need to have a lower rigidity for effectively vibrating and transmitting pressure energy to the pressure chamber, such energy-transmitting area of the pressure chamber may not be set to a greater rigidity. Accordingly, the rigidity of the pressure chamber as a whole may not be increased so easily.

Further, if a rigidity of the pressure chamber as a whole may be set to a lower level by setting a structural compliance of parts configuring a pressure chamber smaller than a compression compliance of a recording agent (e.g., liquid) as above mentioned, a compliance of the pressure chamber as a whole may become greater. In other words, the rigidity of the pressure chamber as a whole may become smaller, which may result into a longer resonance cycle of the pressure chamber, which is not preferable for producing an image having higher quality.

Further, although the rigidity of a pressure chamber as a whole can be set greater by using a vibration plate configured with a plurality of layers as above mentioned, such vibration plate may need a complicated or time consuming manufacture process, or such vibration plate may cause to restrict a structural design of a recording head, which is not preferable from a view point of manufacturing cost or design works of a recording head.

BRIEF SUMMARY

The present disclosure discloses a liquid dispenser head including a plurality of nozzles, a plurality of pressure chambers, an energy generator, a shared chamber, a vibration member, and a specific wall portion. The plurality of nozzles discharges liquid. Each pressure chamber communicates with a corresponding nozzle. The energy generator, provided for each pressure chamber, generates energy for pressurizing liquid in the pressure chamber. The shared chamber supplies liquid to the pressure chambers. The vibration member, forming a wall of each pressure chamber, includes an energy-transmitting area configured to transmit the energy generated by the energy generator to each pressure chamber. The specific wall portion, constituting a part of the same wall or a different wall of each pressure chamber, has a structural compliance set greater than a compression compliance of liquid in the pressure chamber.

The present disclosure also discloses an image forming apparatus having a liquid dispenser head including a plurality of nozzles, a plurality of pressure chambers, an energy generator, a shared chamber, a vibration member, and a specific wall portion. The plurality of nozzles discharges liquid. Each pressure chamber communicates with a corresponding nozzle. The energy generator, provided for each pressure chamber, generates energy for pressurizing liquid in the pressure chamber. The shared chamber supplies liquid to the pressure chambers. The vibration member, forming a wall of each pressure chamber, includes an energy-transmitting area configured to transmit the energy generated by the energy generator to each pressure chamber. The specific wall portion, constituting at least a part of the same or a different wall of each pressure chamber, has a structural compliance set greater than a compression compliance of liquid in the pressure chamber.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
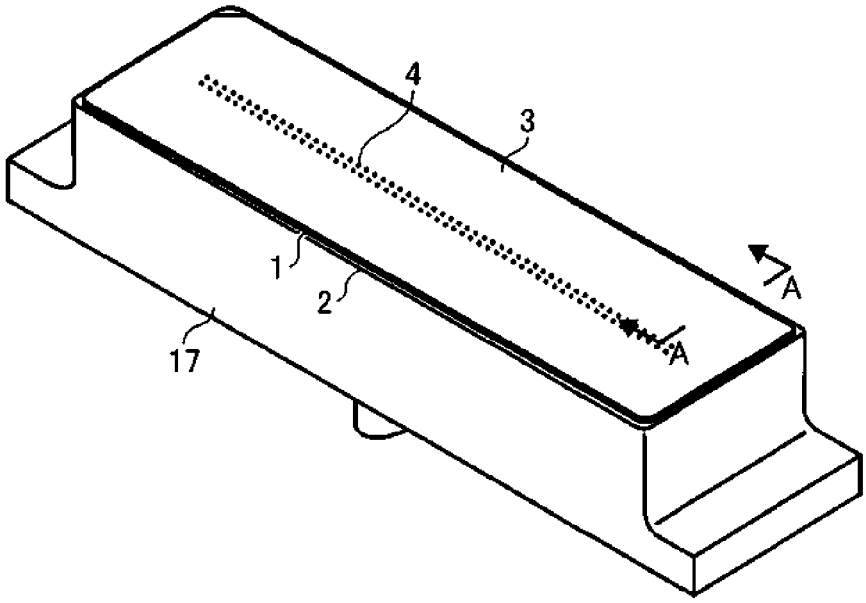
FIG. 1 shows a perspective view of a liquid dispenser head according to an exemplary embodiment.

The accompanying drawings are intended to depict examples and exemplary embodiments of the present invention and should not be interpreted to limit the scope of this disclosure. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of examples and exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present disclosure.

In addition, it should be noted that the terminology used herein is for the purpose of describing particular embodiments only and is not intended to be limiting of the present disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing exemplary embodiments shown in the drawings, specific terminology is employed for the sake of clarity, the present disclosure is not limited to the specific terminology so selected and it is to be understood that each specific element includes all technical equivalents that operate in a similar manner.

Referring now to the drawings, a liquid dispenser head according to an exemplary embodiment is described with particular reference to FIGS. 1 to 4. In this disclosure, "inkjet method," "jetting method" or the like are similarly used, and "dispense" "jet" "dispensing", "jetting" are similarly used.

Figure 2:
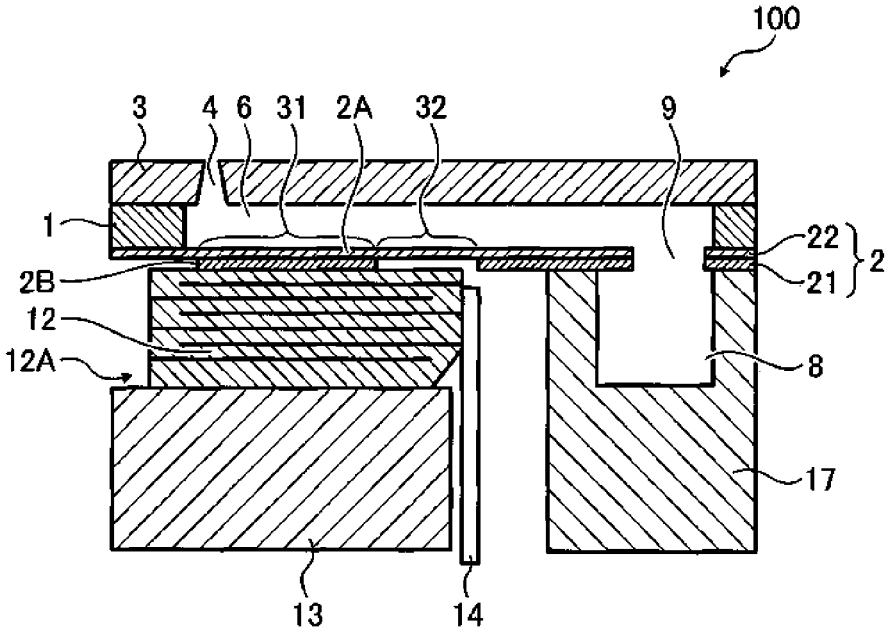
FIG. 2 shows a cross-sectional view of the liquid dispenser head of FIG. 1.
Figure 3:
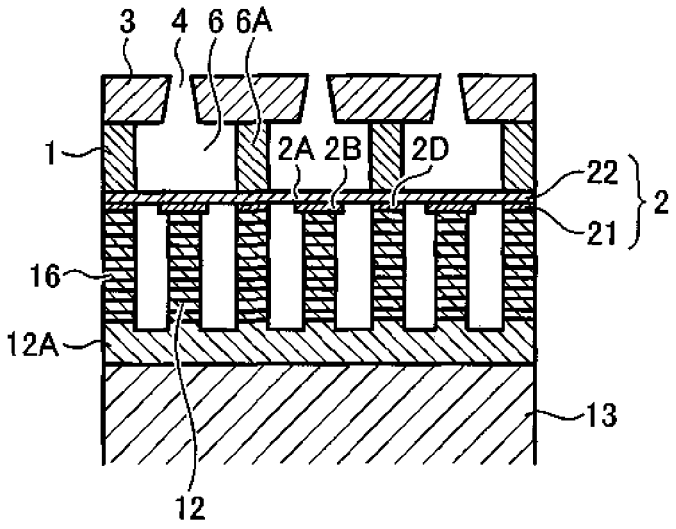
FIG. 3 shows another cross-sectional view of the liquid dispenser head of FIG. 1.
Figure 4:
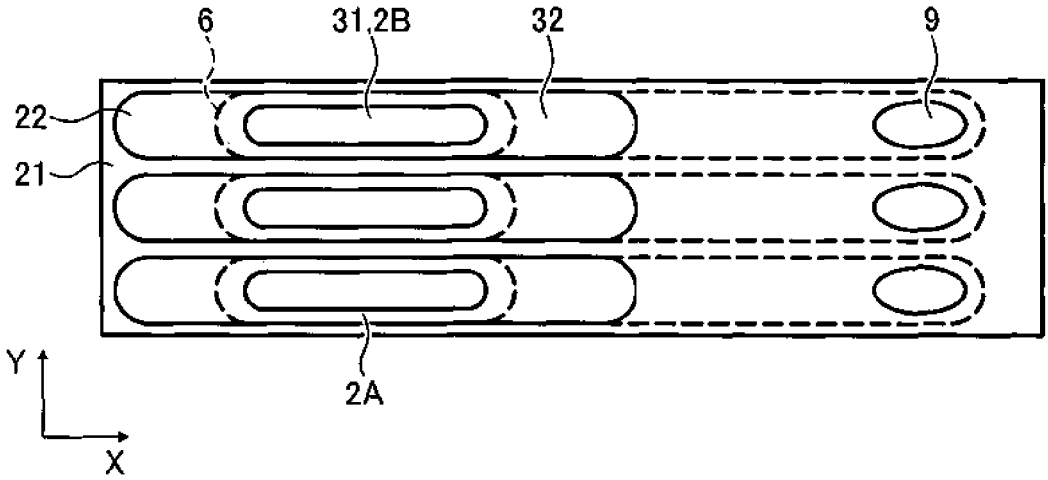
FIG. 4 shows a plan view of a pressure chamber of the liquid dispenser head of FIG. 1.

FIG. 1 shows a side view of the liquid dispenser head 100. FIG. 2 shows a cross-sectional view of the liquid dispenser head 100 taken along the A-A line in FIG. 1. FIG. 3 shows a cross-sectional view of the liquid dispenser head 100 of FIG. 1 taken along a longitudinal direction. FIG. 4 shows a plan view of the pressure chamber shown in FIG. 3 viewed from a piezoelectric element.

As illustrated in FIG. 3, the liquid dispenser head 100 includes a base plate 1, a vibration member 2, a nozzle plate 3 having nozzles, for example. The vibration member 2 is bonded to one face (e.g., lower face) of the base plate 1, and the nozzle plate 3 is bonded to another face (e.g. upper face) of the base plate 1 as illustrated in FIG. 3. The base plate 1 may be made of SUS (stainless) plate, for example.

Further, the liquid dispenser head 100 includes a pressure chamber 6 configured with the base plate 1, the vibration member 2, and the nozzle plate 3. The pressure chamber 6 communicates with the nozzle 4 for discharging liquid droplets, and one pressure chamber may be provided for one nozzle. As illustrated in FIG. 1, the nozzle 4 includes a plurality of nozzles, and the pressure chamber 6 includes a plurality of pressure chambers as illustrated in FIG. 4. Hereinafter, one or more nozzles on the nozzle plate 3 are referred as "nozzle 4." Similarly, one or more pressure chambers are referred as "pressure chamber 6."

Recording liquid (e.g., ink) is supplied from a common chamber 8, formed in a frame 17, to the pressure chamber 6, in which recording liquid (e.g., ink) is supplied from the common chamber 8 to the pressure chamber 6. Further, recording liquid is supplied to the common chamber 8 from a liquid tank (not illustrated).

The pressure chamber 6 can be formed on the base plate 1 by known methods such as etching of SUS plate by acidic etching liquid, and punch press, for example.

As illustrated in FIGS. 2 and 3, the vibration member 2, bonded to the base plate 1, includes a metal element 21 and a resin layer 22. Such vibration member 2 can be made by directly forming the resin layer 22 on the metal element 21 (e.g., SUS plate). For example, a resin material having a coefficient of linear expansion greater than a coefficient of linear expansion of the metal element 21 is directly applied on the metal element 21, and then heated and solidified to form the vibration member 2.

As illustrated in FIG. 2, the resin layer 22 of the vibration member 2 has a vibration portion 2A, which is a deformable portion and a wall face of the pressure chamber 6, and an island-like protruded portion 2B is formed on the metal element 21. As illustrated in FIG. 2, the vibration portion 2A and the island-like protruded portion 2B substantially face each other in the vibration member 2. For the simplicity of expression, the island-like protruded portion 2B is termed as "island portion 2B," hereinafter.

Further, another portion of the metal element 21, which is not removed by etching process is used as a pillar portion 2D, wherein the pillar portion 2D is corresponded to a chamber separation wall 6A of the base plate 1 as illustrated in FIG. 3.

In addition to such method, the vibration member 2 can be formed by bonding a resin layer and a metal material with an adhesive agent, or formed of metal such as nickel by conducting an electroforming method, for example.

As illustrated in FIG. 2, the nozzle plate 3 has a number of nozzles (i.e., nozzle 4), having a given diameter (e.g., 10 μm to 30 μm), corresponded to each of pressure chamber 6, and the nozzle plate 3 is bonded to the base plate 1 with an adhesive agent. The nozzle plate 3 can be made of a metal material (e.g., stainless steel, nickel), a resin material (e.g., polyimide resin film), or silicone, or a combination of such materials. Furthermore, the nozzle plate 3 may be coated with a water-repellency film by known methods such as metal plating or application of water-repellency agent to secure effective water-repellency to recording liquid (e.g., ink).

As illustrated in FIG. 2, a pressure generation device is bonded to the island portion 2B of the vibration member 2 while one pressure generation device is provided for each one of the pressure chambers 6. Specifically, such pressure generation device may be a piezoelectric element 12, for example. As illustrated in FIG. 2, the piezoelectric element 12 is also bonded to a base member 13. The piezoelectric element 12 may have a plurality of layers of piezoelectric elements.

As illustrated in FIG. 2, a plurality of piezoelectric elements 12 are formed from one piece of piezoelectric element block 12A by forming a plurality of slits on the piezoelectric element block 12A. As illustrated in FIG. 2, the piezoelectric element block 12A is fixed on the base member 13. Further, as illustrated in FIG. 2, a FPC (flexible printed circuits) cable 14 is connected to one end face of the piezoelectric element 12 to apply a drive pulse signal to the piezoelectric element 12.

In such configuration, the plurality of piezoelectric elements 12 in one row may include two types of piezoelectric elements. One type is used as piezoelectric element 12 for driving the head, and other type is not used as piezoelectric element 12 but only used as support member (hereinafter, "support member 16") although both types are made of same piezoelectric element material. As illustrated in FIG. 3, two types of piezoelectric elements 12 are alternately arranged on the piezoelectric element block 12A.

The chamber separation wall 6A of the base plate 1 is bonded to the resin layer 22 of the vibration member 2 with an adhesive agent, and the island portion 2B is bonded to the piezoelectric element 12 with an adhesive agent. The pillar portion 2D is bonded to the support member 16, not used as piezoelectric element, with an adhesive agent.

As illustrated in FIG. 2, the piezoelectric element 12 includes a piezoelectric layer and an internal electrode, wherein the piezoelectric layer is made of lead zirconium titanate (PZT) having a thickness of 10 μm to 50 μm per layer, and the internal electrode is made of silver/palladium (AgPd) having a thickness of several μm per layer, for example. More specifically, a plurality of piezoelectric layers and a plurality of internal electrodes are alternately stacked each other to form the piezoelectric element 12. Such internal electrode has an end face, which is connected to an external electrode (not illustrated).

When the piezoelectric element 12 expands and contracts in a direction of d33, which indicates expansion and contraction of the piezoelectric element 12 in a direction (or thickness direction) perpendicular to the internal electrode with an effect of piezoelectric constant of the piezoelectric element 12, the vibration portion 2A displaces its position to contract and expand a volume of the pressure chamber 6. For example, the piezoelectric element 12 expands its volume in one direction when a drive signal is applied and charged to the piezoelectric element 12, and the piezoelectric element 12 contracts its volume in an opposite direction when charged electricity is discharged from the piezoelectric element 12.

Although the piezoelectric element 12 is displaced in d33 direction to pressurize ink in the pressure chamber 6 in an exemplary embodiment, the piezoelectric element 12 can be displaced in d31 direction to pressurize ink in the pressure chamber 6.

The base member 13 is preferably made of a metal material. If the base member 13 is made of metal, a heat accumulation of the piezoelectric element 12 by self-heating can be suppressed or prevented. In general, if the base member 13 has a greater coefficient of linear expansion, an adhesive agent, bonding the base member 13 and the piezoelectric element 12, may peel of f when atmosphere temperature changes to a higher temperature or lower temperature. Such peel-off phenomenon due to temperature change (or environmental condition change) may not occur when a length of one piezoelectric element is not so long.

However, a length of one piezoelectric element has been becoming longer recently. For example, one piezoelectric element has relatively longer length (e.g., 30 mm to 40 mm or more) due to an increased number of nozzles for one recording head. For example, one recording head may have about 400 nozzles for 300 dpi (dot per inch) resolution. Accordingly, such peel-off phenomenon due to temperature change (or environmental condition change) may become significant drawback. In view of such peel-off phenomenon, the base member 13 is preferably made of a material having a coefficient of linear expansion (or thermal expansion coefficient) of 10E-6/° C. or less. Specifically, it was confirmed that if a thermal expansion coefficient of parts to be bonded to the piezoelectric element 12 is set to 10E-6/° C. or less, the above-mentioned peel-off phenomenon at a bonding face is effectively suppressed. Such parts may be made of stainless steel plate, for example.

As illustrated in FIG. 2, the vibration member 2 is also bonded to the frame 17 with an adhesive agent, and the frame 17 has the common chamber 8 therein. Such common chamber 8 is used to supply liquid to a plurality of pressure chambers 6 through a supply port 9 formed in the vibration member 2.

Droplets of recording liquid can be discharged from the liquid dispenser head 100 as follows. For example, a first voltage, lower than a reference voltage, is applied to the piezoelectric element 12 to contract the piezoelectric element 12. When the piezoelectric element 12 contracts, the vibration member 2 is pulled by the piezoelectric element 12. Such movement of the vibration member 2 may increase a volume of the pressure chamber 6, by which ink is induced to the pressure chamber 6 from the common chamber 8. Then, a second voltage, increased from the first voltage is applied to the piezoelectric element 12 to expand the piezoelectric element 12. When the piezoelectric element 12 expands, the vibration member 2 deforms its shape toward a direction of the nozzle 4, and the volume of the pressure chamber 6 is decreased, by which recording liquid in the pressure chamber 6 is pressurized and droplets of recording liquid is discharged from the nozzle 4.

After discharging a liquid droplet, a third voltage (or reference voltage) is applied to the piezoelectric element 12 and the vibration member 2 returns to its original position. When the vibration member 2 returns to its original position, the pressure chamber 6 expands its volume, by which a negative pressure is generated in the pressure chamber 6. Accordingly, recording liquid is refilled to the pressure chamber 6 from the common chamber 8 with an effect of such negative pressure. When a vibration of meniscus face of the nozzle 4 is damped to a stable level, a next discharging operation of liquid droplets can be started.

The liquid dispensing head H can be driven by any head driving methods such as pull-push driving method and push driving method, for example, in which a drive pulse signal is applied to piezoelectric element 12 as follows.

In case of pull-push driving method, a voltage lower than a reference voltage is applied to a piezoelectric element to contract the piezoelectric element and increase a volume of a pressure chamber at first, and then a voltage of reference voltage is applied to the piezoelectric element to expand the piezoelectric element and to decrease the volume of the pressure chamber so that a liquid droplet is discharged from a nozzle.

In case of push driving method, a voltage greater than a reference voltage is applied to a piezoelectric to move a vibration plate toward a pressure chamber so that a liquid droplet is discharged from a nozzle.

A description is now given to the vibration member 2 of the liquid dispenser head 100 with reference to FIGS. 2 to 4. The vibration member 2 includes an energy-transmitting area 31 and a specific wall portion 32 on the resin layer 22.

As illustrated in FIG. 2, the energy-transmitting area 31 is corresponded to the island portion 2B, and the specific wall portion 32 is positioned at a given position in the liquid dispenser head 100. For example, the specific wall portion 32 may be positioned between the common chamber 8 and the vibration portion 2A as illustrated in FIG. 2.

As illustrated in FIG. 4, the vibration portion 2A set around the energy-transmitting area 31 and the island portion 2B may have an elongated oval-like shape, for example.

As also illustrated in FIG. 4, the specific wall portion 32 is provided adjacently to one end of the vibration portion 2A, and the specific wall portion 32 is positioned at a given position between the common chamber 8 and the vibration portion 2A, for example. In an exemplary embodiment, the specific wall portion 32 has a structural compliance, which is set greater than a compression compliance of liquid (e.g., ink) reserved in the pressure chamber 6.

In such configuration of the liquid dispenser head 100, a resonance may occur from the nozzle 4 to the specific wall portion 32 in the pressure chamber 6 when the piezoelectric element 12 pressurizes liquid in the pressure chamber 6.

A resonance cycle of the pressure chamber 6 becomes shorter when a resonance space of the pressure chamber 6 is set smaller. In an exemplary embodiment, a resonance space of the pressure chamber 6 may extend from the nozzle 4 to the specific wall portion 32, which is a relatively smaller space. If the pressure chamber 6 is not provided with the specific wall portion 32, a resonance may occur from the nozzle 4 to the common chamber 8 in the pressure chamber 6, which is a relatively greater space, and a resonance cycle of the pressure chamber 6 may become relatively longer.

A description is now given to a compliance relationship for the liquid dispenser head 100 as follows. In an exemplary embodiment, the pressure chamber 6 has a height of 50 μm in a direction to the nozzle 4, a width of 120 μm (in Y direction in FIG. 4), and a length of 2,000 μm (in X direction in FIG. 4), for example. The height, width, and length of the pressure chamber 6 may be changed to any value within the scope of the present disclosure.

Compression compliance "Cink" of liquid (e.g., ink) in the pressure chamber 6 can be computed with a following formula (1).

$$Cink=V/K \quad (1)$$

wherein "V" is a volume of the pressure chamber 6, and "K" is a modulus of volume elasticity of reserved liquid.

For example, liquid such as ink may have a modulus of volume elasticity of about 2E9 Pa, and the pressure chamber 6 has a height of 50 μm, a width of 120 μm, and a length of 2,000 μm in an exemplary embodiment.

Accordingly, the compression compliance Cink of liquid in the pressure chamber 6 can be computed as Cink=6E-21 $m^3$/Pa by inputting each value of volume "V" of the pressure chamber 6 and "K" of modulus of volume elasticity of liquid into the formula (1).

On one hand, structural compliance Cs of the specific wall portion 32 can be computed with a following formula (2).

$$Cs=8LW^5/(525Et^3) \quad (2)$$

wherein the specific wall portion 32 has a length L, a width W, a Young's modulus E, and a thickness t.

As above described, the specific wall portion 32, set between the energy-transmitting area 31 and the common chamber 8, is formed only by a resin layer (e.g., polyimide layer), for example. It should be noted that the formula (2) is applicable if the specific wall portion 32 has a substantially rectangular-like shape as in an exemplary embodiment.

In an exemplary embodiment, the specific wall portion 32 has L=200 μm, W=120 μm, E=5.3E9 Pa, t=6 μm, for example. Accordingly, a structural compliance Cs of the specific wall portion 32 can be computed as Cs=6.6E-20 $m^3$/Pa by inputting each value of length L, width W, Young's modulus E, and thickness t into the formula (2).

Therefore, the structural compliance Cs becomes greater than the compression compliance Cink (i.e., Cink<Cs) in an exemplary embodiment.

In conventional arts, it has been assumed that a resonance cycle of a pressure chamber of a liquid dispensing head becomes longer if the pressure chamber has a portion having such greater structural compliance.

However, based on research and investigation in connection with the subject matter of the present disclosure, it is confirmed that a resonance cycle of a pressure chamber of a liquid dispensing head can be set shorter if a structural compliance of the specific wall portion 32 of the pressure chamber 6 is set greater than a given level. In an exemplary embodiment, the structural compliance of the specific wall portion 32 is set greater than the compression compliance of liquid reserved in the pressure chamber 6, for example.

Figure 5:
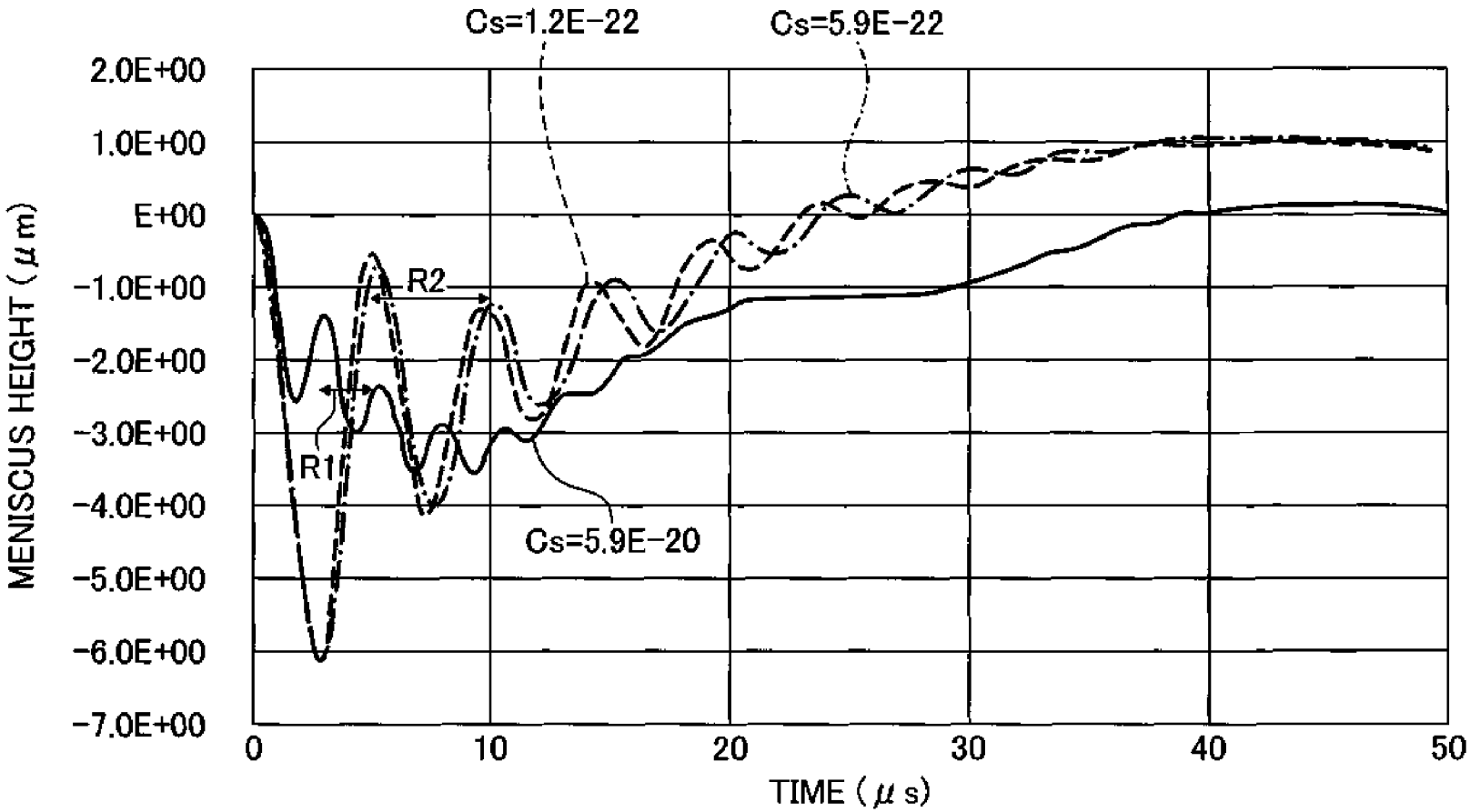
FIG. 5 shows a simulated result illustrating a relationship of structural compliance of a specific wall portion of the liquid dispenser head and a nozzle meniscus height.

Further, an effect of structural compliance of the specific wall portion 32 was evaluated with a simulation of a motion of liquid meniscus formed in the nozzle 4. FIG. 5 shows a result of such simulation.

In such simulation, a motion of liquid meniscus in the nozzle 4 when the piezoelectric element 12 is driven by a drive impulse having a simple waveform was simulated under a condition of different structural compliance Cs of the specific wall portion 32. Based on such simulation result, a resonance cycle of the pressure chamber 6 can be evaluated. Such simulation was conducted using the above-mentioned condition that the pressure chamber 6 has a length of 2,000 μm, a width of 120 μm, and a height of 50 μm.

As shown in FIG. 5, the greater the structural compliance Cs of the specific wall portion 32, the shorter the resonance cycle of the pressure chamber 6.

For example, if the structural compliance Cs of the specific wall portion 32 is set to 5.9E-20 $m^3$/Pa, the resonance cycle of the pressure chamber 6 becomes about 2 μs, which is a relatively shorter resonance cycle (see an arrow R1 in FIG. 5). On the other hand, if the structural compliance Cs of the specific wall portion 32 is set to 1.2E-22 $m^3$/Pa or 5.9E-22 $m^3$/Pa, the resonance cycle of the pressure chamber 6 becomes about 4 μs, which is a relatively longer resonance cycle (see an arrow R2 in FIG. 5).

Further, an effect of structural compliance of the specific wall portion 32 was evaluated with a measurement of droplet speed dispensed from a liquid dispensing head.

Figure 6A:
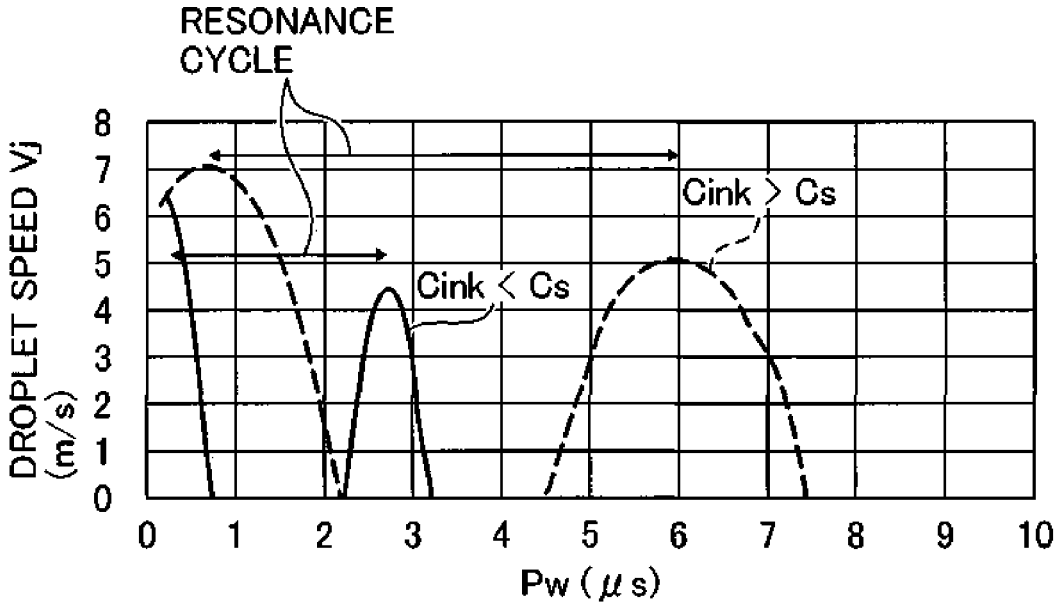
FIG. 6A shows a result illustrating a relationship of a resonance cycle of a liquid dispenser head and a compression compliance of liquid, and a structural compliance of a specific wall portion of the liquid dispenser.

FIG. 6A shows a measurement result of droplet speed dispensed from a liquid dispensing head having a greater structural compliance (i.e., Cink<Cs) and a liquid dispensing head having a smaller structural compliance (i.e., Cink>Cs).

Figure 6B:
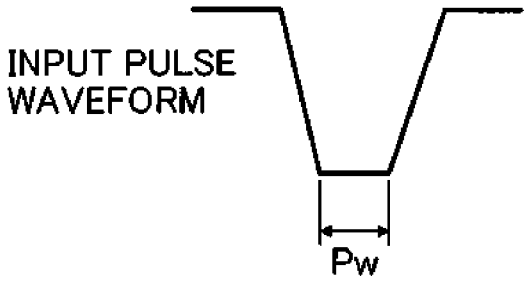
FIG. 6B shows an example pulse waveform applied to the liquid dispenser head.

As shown in FIG. 6A, a droplet speed Vj of liquid dispensed from the nozzle 4 was measured by changing a pulse time Pw of a drive pulse having a waveform shown in FIG. 6B. The drive pulse is applied to the piezoelectric element 12 by a pull-push driving method, for example.

Because each pressure chamber has a given compliance, different pressure chambers may exhibit different discharge performance on droplet speed Vj. In FIG. 6A, a resonance cycle of the pressure chamber 6 is indicated by a time period between peaks of the droplet speed Vj for each liquid dispensing head.

As shown in FIG. 6A, a resonance cycle of the pressure chamber 6 can be set significantly shorter when the structural compliance of the specific wall portion 32 is greater than the compression compliance Cink (i.e., Cink<Cs) compared to when the structural compliance of the specific wall portion 32 is smaller than the compression compliance Cink (i.e., Cs<Cink).

Such dispensing performance of the liquid dispensing head may be caused by a configuration of the nozzle 4 and the specific wall portion 32 in the pressure chamber 6. Specifically, by setting the structural compliance Cs of the specific wall portion 32 to a greater value, the resonance cycle of the pressure chamber 6 can be set shorter.

Such specific wall portion 32 according to an exemplary embodiment may not be provided for a conventional liquid dispensing head, by which a resonance may occur from a nozzle to a common chamber in a conventional liquid dispensing head, which is a relatively greater length.

On the other hand, in an exemplary embodiment, a resonance may occur from the nozzle 4 to the specific wall portion 32 in the pressure chamber 6, which is shorter than a length between the nozzle 4 and the common chamber 8. Accordingly, a resonance cycle of the pressure chamber 6 can be set shorter because a resonance space, which may be from the nozzle 4 to the specific wall portion 32, can be set shorter.

Figure 7:
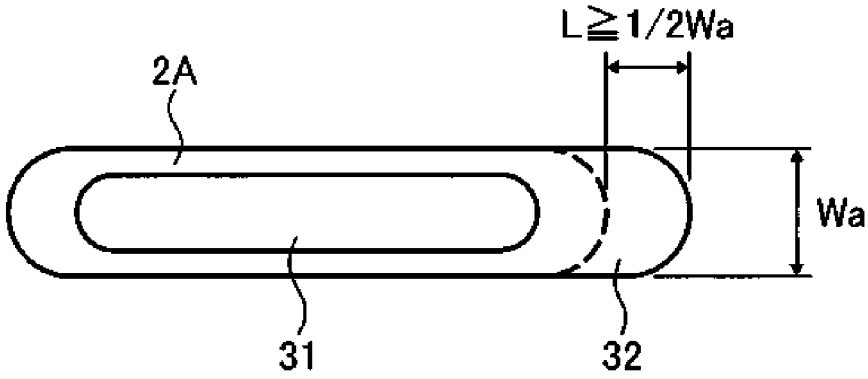
FIG. 7 is a plan view illustrating a relationship of length and width of the specific wall portion of the liquid dispenser head.
Figure 8:
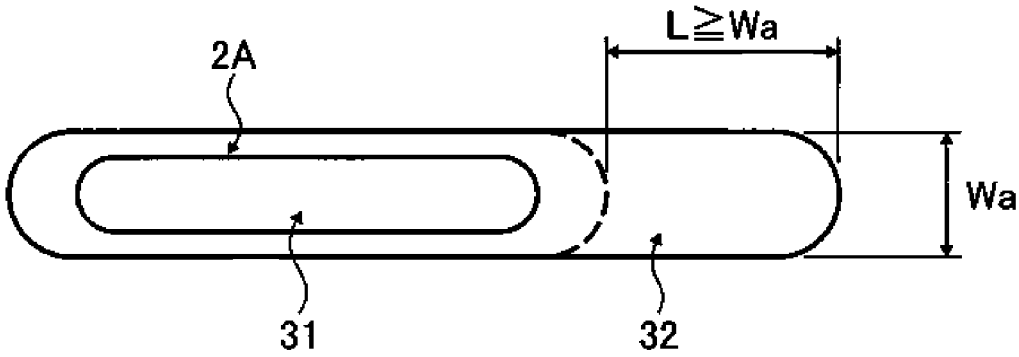
FIG. 8 is another plan view illustrating another relationship of length and width of the specific wall portion of the liquid dispenser head.

Furthermore, a preferable size of the specific wall portion 32 for setting a relationship of "Cink<Cs" for the pressure chamber 6 is determined. The specific wall portion 32 has a width Wa and a length L having a given relationship as illustrated in FIG. 7 or 8. As illustrated in FIG. 7 or 8, the width Wa of the specific wall portion 32 in the pressure chamber 6 is set substantially equal to a width of the pressure chamber 6.

As also illustrated in FIG. 7, the length L and the width wa of the specific wall portion 32 may preferably has a relationship of "L>(½)Wa" to set a compliance relationship of "Cink<Cs" for the pressure chamber 6. If the length L is set shorter than (½)Wa, a resonance may occur from the nozzle 4 to the common chamber 8, which may be superimposed to a resonance from the nozzle 4 to the specific wall portion 32, by which a dispensing performance of a liquid recording dispensing head may become undesirably unstable.

Furthermore, the length L is preferably set greater than the width Wa (i.e., L≧Wa) as illustrated in FIG. 8. When the length L is set as illustrated in FIG. 8, a resonance may be generated from the nozzle 4 to the specific wall portion 32 in the pressure chamber 6 more effectively.

Accordingly, when a size of the specific wall portion 32 is set as illustrated in FIG. 7 or 8, a relationship of "Cink<Cs" for the pressure chamber 6 may be maintained.

As above described, when the structural compliance Cs of the specific wall portion 32 is set greater than the compression compliance Cink of liquid in the pressure chamber 6, a resonance cycle of the pressure chamber 6 can be set shorter, by which a dispensing performance of liquid dispensing head can be enhanced as above described.

Furthermore, from a viewpoint of manufacture process of a liquid dispensing head, a dimensional relationship shown in FIG. 7 or 8 is preferable. In general, a manufacture process of a liquid dispensing head may need to be conducted with a higher precision because parts of liquid dispensing head have dimensions in micron meter (μm). Accordingly, when manufacturing such parts, a size of each part may deviate from designed size, by which a manufacture process may be complicated for coping with such phenomenon. On the other hand, a process of setting a dimensional relationship shown in FIG. 7 or 8 may not be a so demanding process compared to other process such as setting a size of each part. Accordingly, a manufacture process of the specific wall portion 32 can be conducted with less sever requirement. Accordingly, the pressure chamber 6 having a compliance relationship of Cink<Cs and a shorter resonance cycle can be manufactured even some manufacturing variation may occur to a size of the pressure chamber 6.

If the specific wall portion 32 becomes greater, energy of the piezoelectric element 12, which is applied to the pressure chamber 6, may dissipate from the specific wall portion 32. Accordingly, vibration energy of the piezoelectric element 12 used for dispensing liquid droplet from the liquid dispenser head may become smaller, by which an amount of droplet volume may become undesirably smaller, and result into producing an image having poor quality.

In such a case, a size of the pressure chamber 6 and the energy-transmitting area 31 may be set greater. With such enlarged configuration, a volume displaced by a displacement of the pressure chamber 6 can be set greater, by which an enough amount of droplet volume can be dispensed from the liquid dispenser head.

Although a resonance cycle of the pressure chamber 6 in such configuration may become longer due to an increased size of the pressure chamber 6, such resonance cycle of the pressure chamber 6 may be still shorter than a conventional liquid dispensing head, which may resonate from a nozzle to a common chamber.

Figure 9:
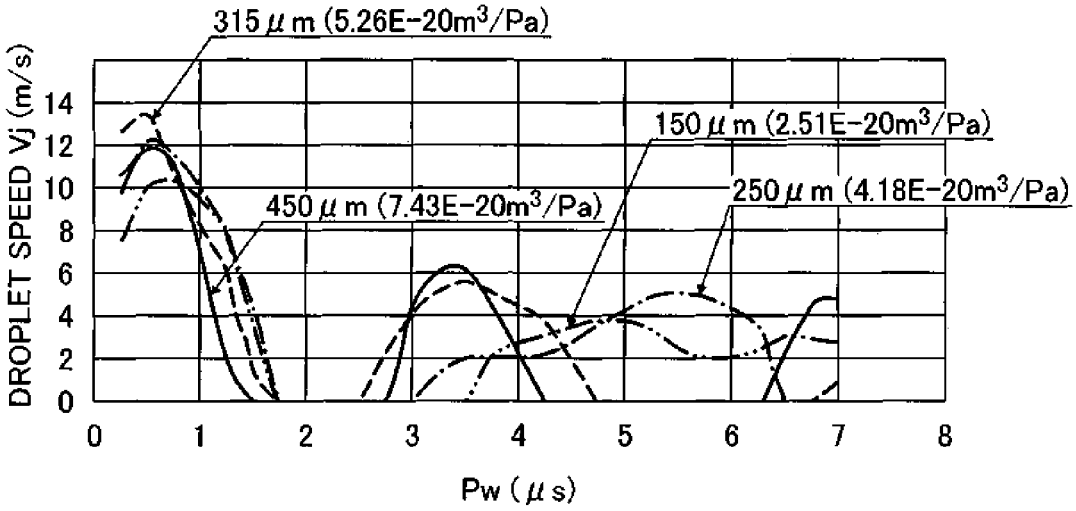
FIG. 9 shows a simulation result illustrating a relationship of a resonance cycle of a liquid dispenser head and a length of a specific wall portion of the liquid dispenser head having different structural compliance.

A description is now given to the length L of the specific wall portion 32 with a reference to FIG. 9, which shows a simulation result indicating an effect of the length L of the specific wall portion 32. A simulation was conducted by inputting 100 μm as the width w of the specific wall portion 32, and four values for the length L of the specific wall portion 32: 150 μm, 250 μm, 315 μm, and 450 μm. As similar to FIG. 6A, FIG. 9 shows a simulation result of droplet speed dispensed from a liquid dispensing head by changing a pulse time Pw of a drive pulse having a waveform shown in FIG. 6B.

Based on the results shown in FIG. 9, when the length L of the specific wall portion 32 is set to 300 μm or greater, a resonance cycle of the liquid dispensing head can be set shorter, and when the length L of the specific wall portion 32 is set to less than 300 μm, a resonance cycle of the liquid dispensing head becomes longer.

Further, based on the results shown in FIG. 9, when a structural compliance of the specific wall portion 32 is set greater than 5E-20 $m^3$/Pa, a resonance may be generated between the nozzle 4 and the specific wall portion 32 more effectively.

Figure 10:
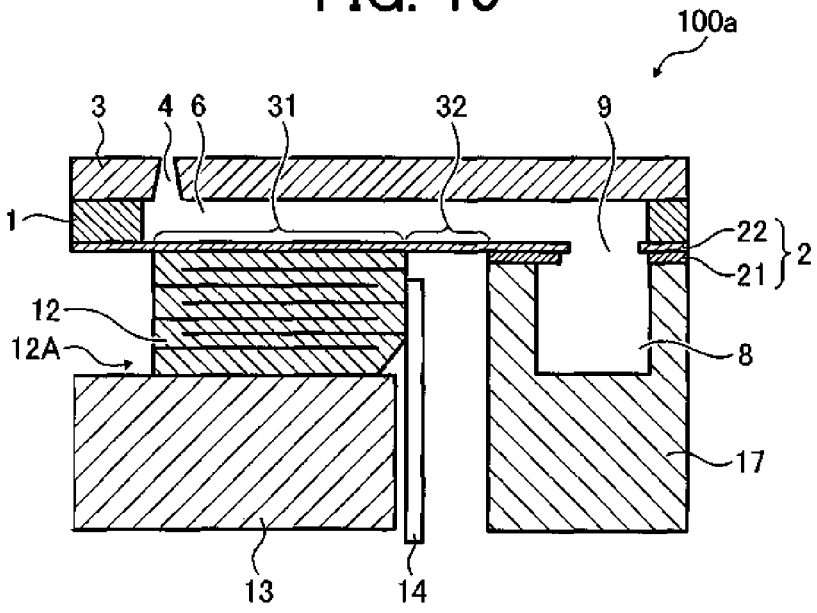
FIG. 10 shows a cross-sectional view of another liquid dispenser head according to another exemplary embodiment.
Figure 11:
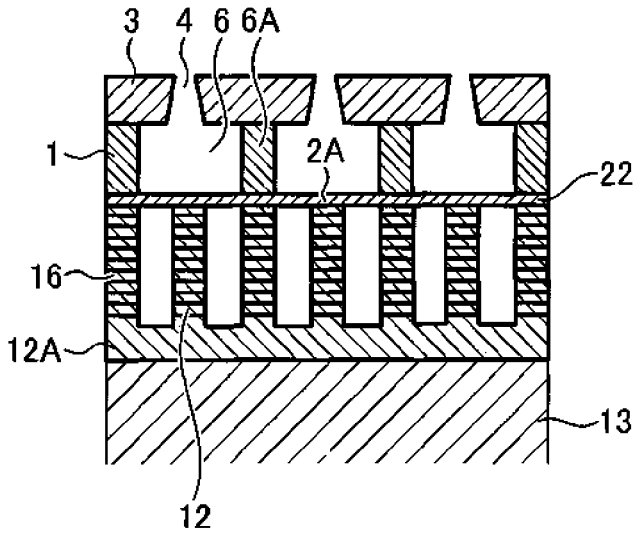
FIG. 11 shows another cross-sectional view of the liquid dispenser head of FIG. 10.
Figure 12:
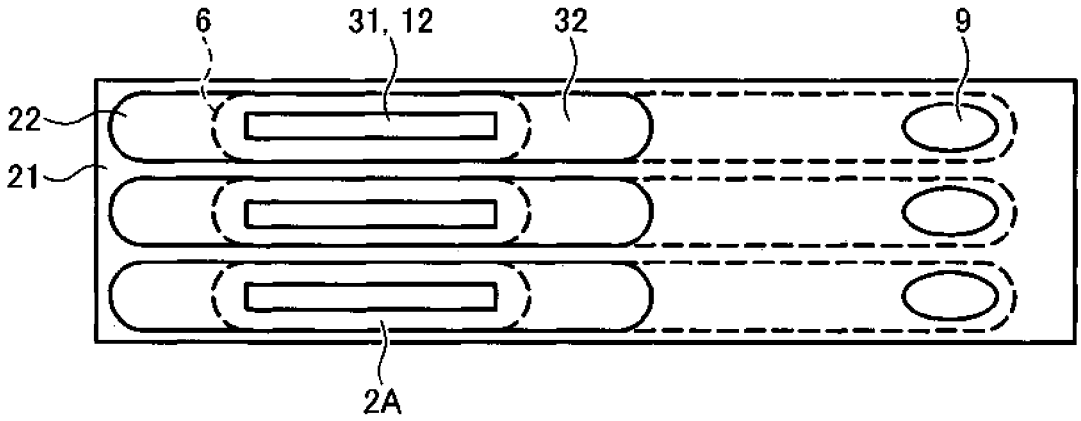
FIG. 12 shows a plan view of a pressure chamber of the liquid dispenser head of FIG. 10.

A description is now given to another liquid dispenser head according to another exemplary embodiment with reference to FIGS. 10 and 12. FIG. 10 shows a cross-sectional view of a liquid dispenser head 100*a* according to another exemplary embodiment. FIG. 11 shows another cross-sectional view of the liquid dispenser head 100*a*. FIG. 12 shows a plan view of the liquid dispenser head 100*a* of FIG. 10 viewed from the piezoelectric element 12.

In the liquid dispenser head 100*a*, the vibration member 2 does not have the island portion 2B so that the piezoelectric element 12 is directly bonded to the resin layer 22 of the vibration member 2. Accordingly, an area of the resin layer 22, which is bonded to the piezoelectric element 12, is used as the energy-transmitting area 31.

In such configuration, a formation of fine pattern of slits (e.g., island portion 2B, pillar portion 2D shown in FIG. 3) may not be needed on the vibration member 2, by which a manufacture process of the vibration member 2 can be streamlined.

As similar to the previously described pressure chamber, the width Wa of the specific wall portion 32 is set substantially equal to a width of the pressure chamber 6, and the length L of the specific wall portion 32 is set with a condition of "L≧(½)Wa" to maintain a relationship of "Cink≦Cs" for the liquid dispenser head 100*a*. If the length L of the specific wall portion 32 is set shorter than (½)Wa, a resonance may occur from the nozzle 4 to the common chamber 8. Such resonance from the nozzle 4 to the common chamber 8 may be superimposed to a resonance from the nozzle 4 to the specific wall portion 32, by which a discharge performance of the recording head may become unstable.

Further, as similar to the previously described pressure chamber, the length L of the specific wall portion 32 is preferably set greater than the width Wa (i.e., L≧Wa) as illustrated in FIG. 8. If the length L of the specific wall portion 32 is set as illustrated in FIG. 8, a resonance may be generated from nozzle 4 to the specific wall portion 32 in the pressure chamber 6 more effectively.

Figure 13:
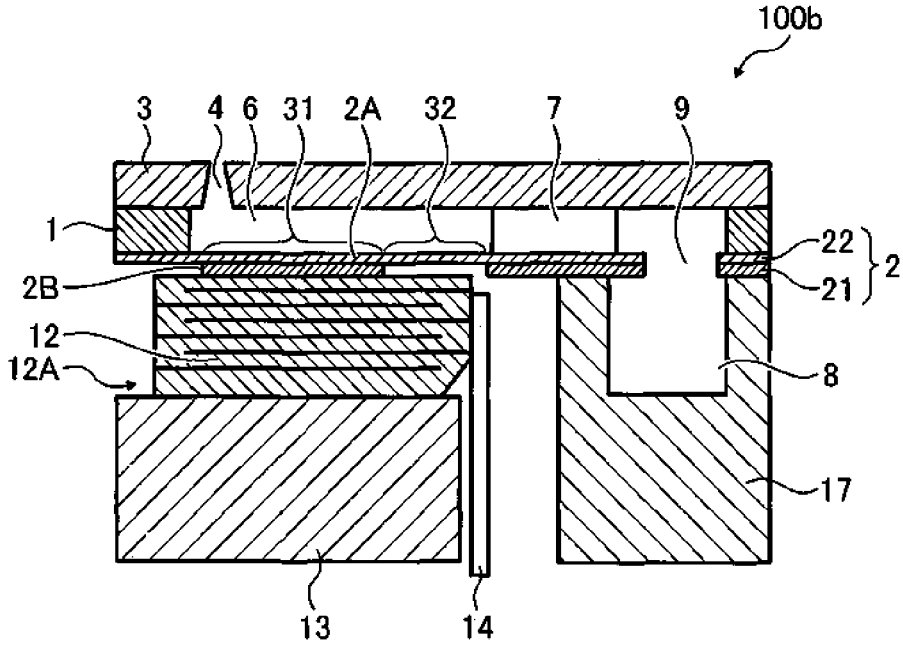
FIG. 13 shows a cross-sectional view of another liquid dispenser head according to another exemplary embodiment.
Figure 14:
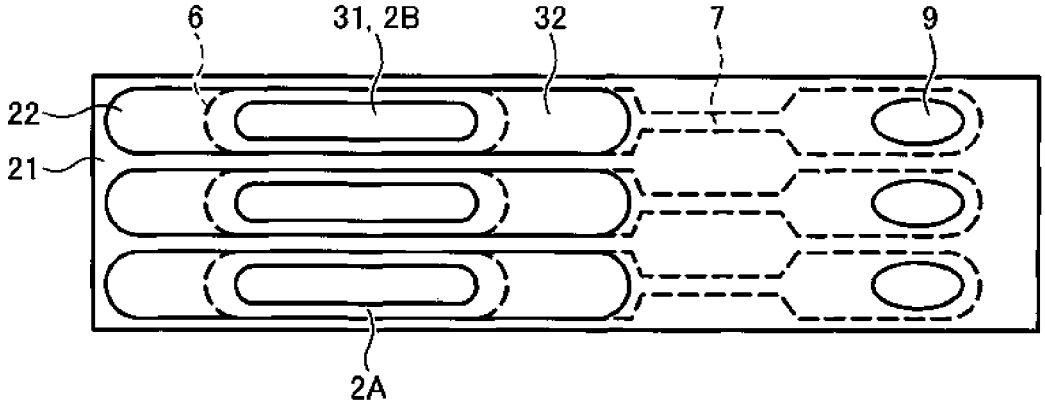
FIG. 14 shows a plan view of a pressure chamber of the liquid dispenser head of FIG. 13.

A description is now given to another liquid dispenser head according to another exemplary embodiment with reference to FIGS. 13 and 14. FIG. 13 shows a cross-sectional view of a liquid dispenser head 100*b* according to another exemplary embodiment. FIG. 14 shows a plan view of the liquid dispenser head 100*b* of FIG. 13 viewed from the piezoelectric element 12.

In the liquid dispenser head 100*b*, a flow restriction portion 7 is provided between the pressure chamber 6 and the common chamber 8. The flow restriction portion 7 has a cross-section area set smaller than a cross-section area of the pressure chamber 6. A responsiveness of the pressure chamber 6 driven at higher frequency can be further enhanced by providing such flow restriction portion 7. The flow restriction portion 7 can be provided in the liquid dispenser head 100*b* by narrowing a width or lowering a height of a portion between the pressure chamber 6 and the common chamber 8 as illustrated in FIG. 14.

When such flow restriction portion 7 is provided, the vibration member 2 may include the specific wall portion 32 between the flow restriction portion 7 and the energy-transmitting area 31, wherein the specific wall portion 32 has a structural compliance set greater than a compression compliance of liquid as similar to the previously described exemplary embodiments. Accordingly, the liquid dispenser head 100*b* may have a similar effect described in the above exemplary embodiments.

Figure 15:
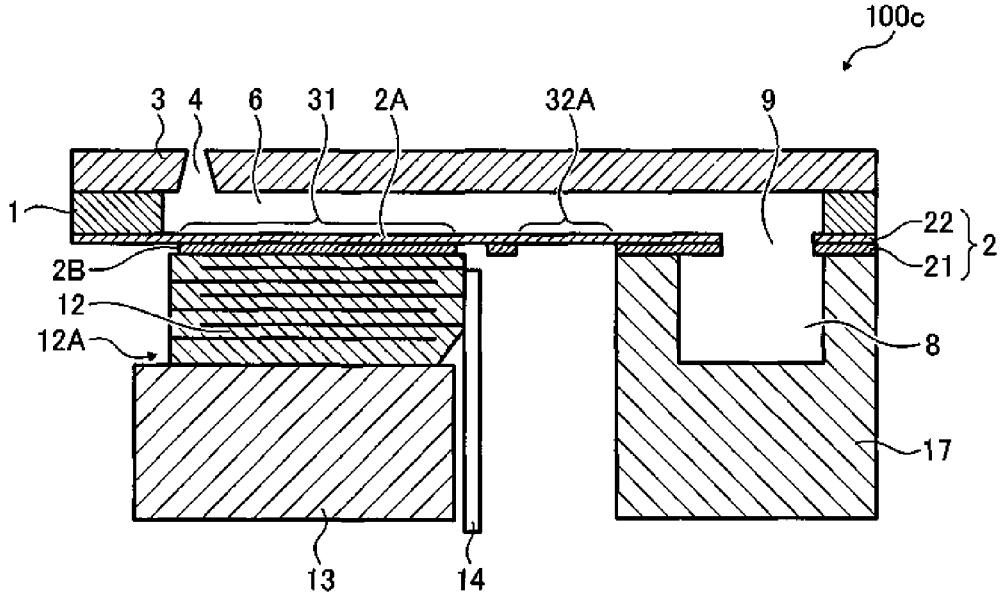
FIG. 15 shows a cross-sectional view of another liquid dispenser head according to another exemplary embodiment.
Figure 16:
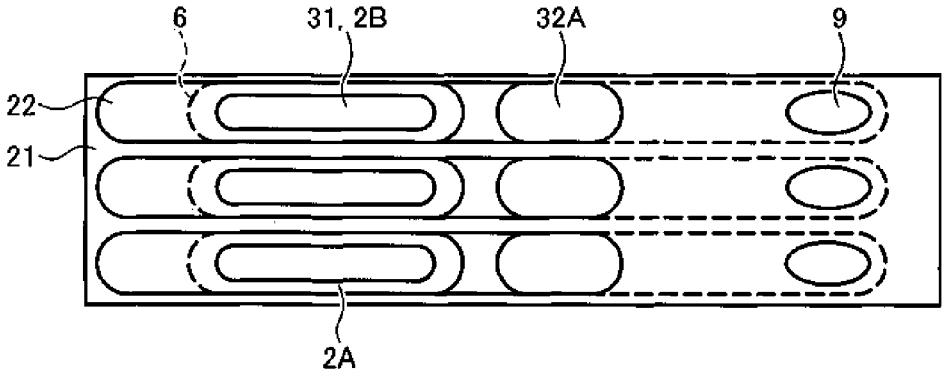
FIG. 16 shows a plan view of a pressure chamber of the liquid dispenser head of FIG. 15.

A description is now given to another liquid dispenser head according to another exemplary embodiment with reference to FIGS. 15 and 16. FIG. 15 shows a cross-sectional view of a liquid dispenser head 100*c* according to another exemplary embodiment. FIG. 16 shows a plan view of the liquid dispenser head 100*c* of FIG. 15 viewed from the piezoelectric element 12.

In FIGS. 15 and 16, the vibration member 2 includes a specific wall portion 32A between the vibration portion 2A and the common chamber 8, wherein the specific wall portion 32A is disposed separately from the vibration portion 2A, which is different from the previous exemplary embodiments.

The specific wall portion 32A has a structural compliance set greater than a compression compliance of liquid as similar to the specific wall portion 32. Accordingly, the liquid dispenser head 100*c* may have a similar effect described in the above exemplary embodiments.

In the above described exemplary embodiments, the vibration portion 2A and the specific wall portions 32 and 32A may have substantially similar thickness because the vibration portion 2A and the specific wall portion 32 and 32A are a portion of the resin layer 22, having a thinner thickness, of the vibration member 2. Accordingly, the vibration portion 2A and the specific wall portion 32 and 32A may have a thinner thickness. Such specific wall portion 32 or 32A can be prepared to have a given shape and size, which can set a structural compliance greater than a compression compliance of liquid.

Figure 17:
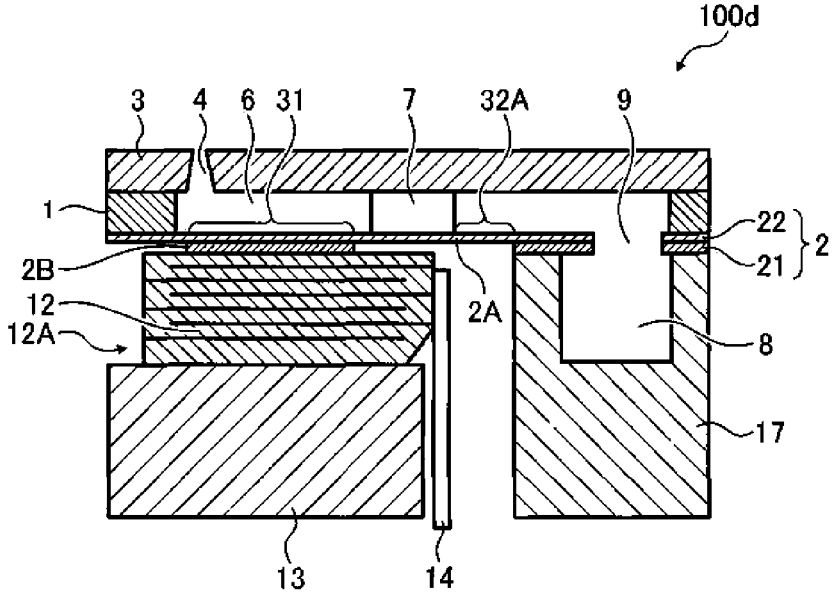
FIG. 17 shows a cross-sectional view of another liquid dispenser head according to another exemplary embodiment.
Figure 18:
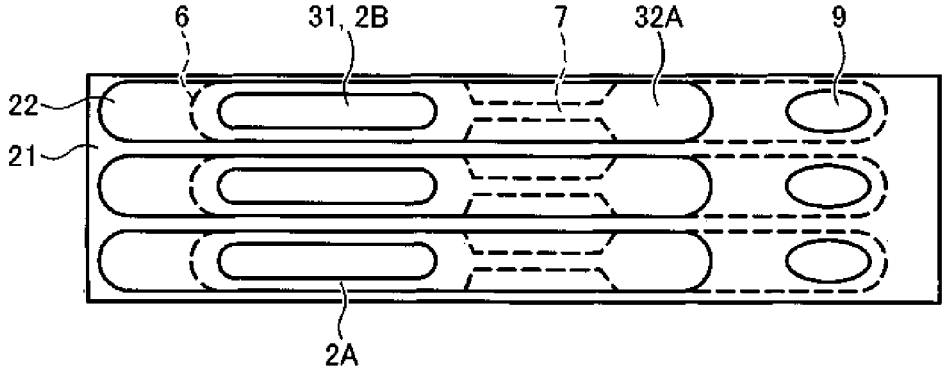
FIG. 18 shows a plan view of a pressure chamber of the liquid dispenser head of FIG. 17.

A description is now given to another liquid dispenser head according to another exemplary embodiment with reference to FIGS. 17 and 18. FIG. 17 shows a cross-sectional view of a liquid dispenser head 100*d* according to another exemplary embodiment. FIG. 18 shows a plan view of the liquid dispenser head 100*c* of FIG. 17 viewed from the piezoelectric element 12.

In FIGS. 17 and 18, the vibration member 2 includes the specific wall portion 32A between the flow restriction portion 7 and the common chamber 8, wherein the specific wall portion 32A is disposed separately from the vibration portion 2A. The specific wall portion 32A has a structural compliance set greater than a compression compliance of liquid. Accordingly, the liquid dispenser head 100*d* may have a similar effect described in the above exemplary embodiments.

Figure 19:
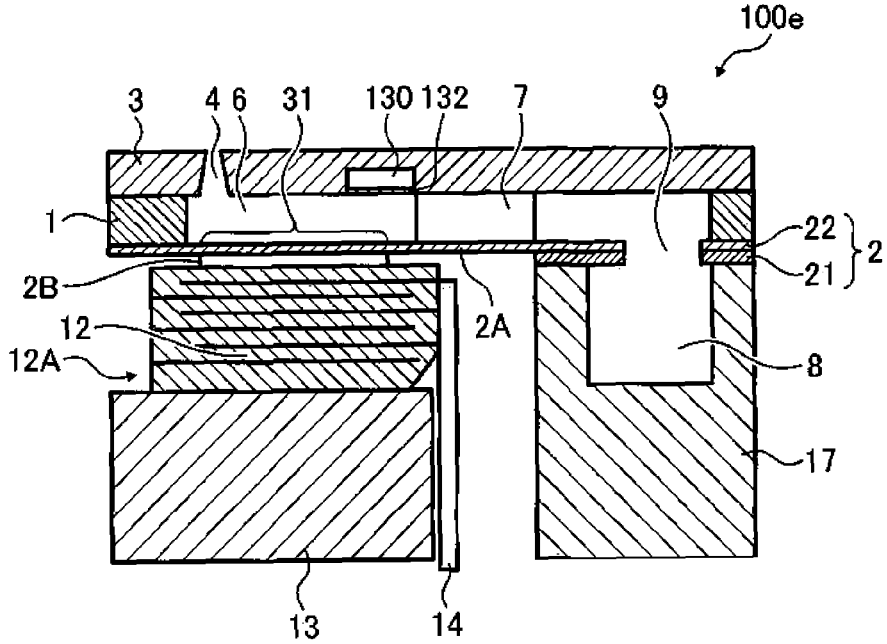
FIG. 19 shows a cross-sectional view of another liquid dispenser head according to another exemplary embodiment.

A description is now given to another liquid dispenser head according to another exemplary embodiment with reference to FIG. 19. FIG. 19 shows a cross-sectional view of a liquid dispenser head 100*e* according to another exemplary embodiment.

In FIG. 19, the nozzle plate 3 includes a concaved portion 130 and a specific wall portion 132 made of polyimide film, which is different from the previously described exemplary embodiments. The specific wall portion 132 may be provided over the concaved portion 130 so as to cover an opening of the concaved portion 130. The specific wall portion 132 has a structural compliance set greater than a compression compliance of liquid as similar to the specific wall portion 32 described in the previous embodiments.

Because the nozzle plate 3 and the vibration member 2 are components configuring the pressure chamber 6, and provided spatially apart each other, the concaved portion 130 and the specific wall portion 32 are positioned over the vibration member 2 as illustrated in FIG. 19.

Because the specific wall portion 132, having a greater structural compliance, is provided between the nozzle 4 and the flow restriction portion 7, a resonance may occur between the nozzle 4 and the specific wall portion 132 in the pressure chamber 6, thereby a resonance cycle in the pressure chamber 6 can be set shorter, and the liquid dispensing head 100*e* can dispense droplets with a higher frequency or higher responsiveness. Accordingly, the liquid dispenser head 100*e* may have a similar effect described in the above described exemplary embodiments.

Figure 20:
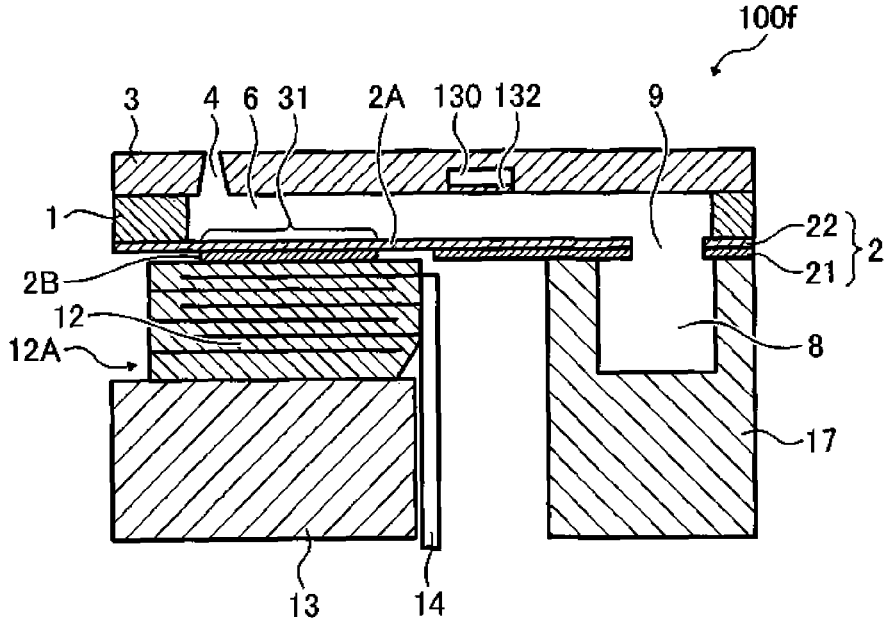
FIG. 20 shows a cross-sectional view of another liquid dispenser head according to another exemplary embodiment.

A description is now given to another liquid dispenser head according to another exemplary embodiment with reference to FIG. 20. FIG. 20 shows a cross-sectional view of a liquid dispenser head 100*f* according to another exemplary embodiment. In FIG. 20, the nozzle plate 3 includes the concaved portion 130 and the specific wall portion 132 made of polyimide film as similar to the liquid dispenser head 100*e* of FIG. 19 except that the flow restriction portion 7 is not provided.

In FIG. 20, the specific wall portion 132, having a greater structural compliance, is provided between the nozzle 4 and the common chamber 8 while keeping the position of the specific wall portion 132 off from the energy-transmitting area 31 when viewed from the nozzle plate 3.

In such configuration, the specific wall portion 132, having a greater structural compliance, does not face the energy-transmitting area 31 of the vibration member 2, which transmits displacement energy of the piezoelectric element 12 to the liquid in the pressure chamber 6.

Accordingly, the specific wall portion 132, having a structural compliance greater than a compression compliance of the liquid in the pressure chamber 6, may absorb little amount of energy transmitted to the liquid from the energy-transmitting area 31, thereby a pressure energy can be applied to the liquid in the pressure chamber 6 more effectively. Such liquid dispenser head 100*f* may have a similar effect described in the above exemplary embodiments.

Figure 21:
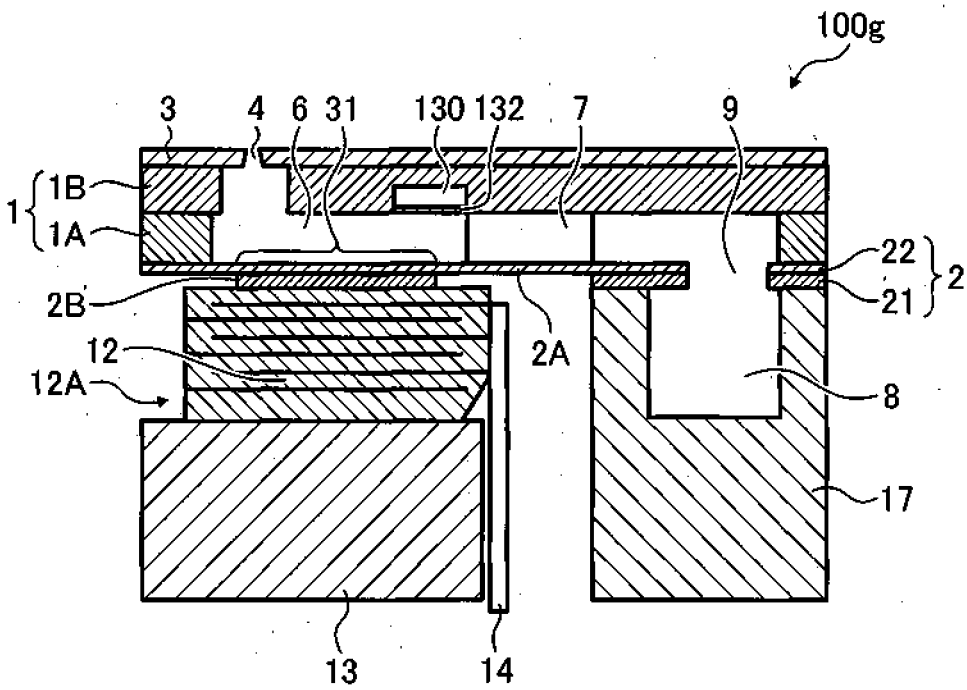
FIG. 21 shows a cross-sectional view of another liquid dispenser head according to another exemplary embodiment.

A description is now given to another liquid dispenser head according to another exemplary embodiment with reference to FIG. 21. FIG. 21 shows a cross-sectional view of a liquid dispenser head 100*g* according to another exemplary embodiment. In FIG. 21, the base plate 1 is configured with a first plate 1A and a second plate 1B, stacked each other, to configure wall faces of the pressure chamber 6. The second plate 1B includes a nozzle path 5 to communicate the pressure chamber 6 with the nozzle 4.

The second plate 1B further includes the concaved portion 130 and the specific wall portion 132 made of polyimide film as similar to the liquid dispensing heads 100*e* and 100*f*.

Because the second plate 1B and the vibration member 2 are components configuring the pressure chamber 6, and provided spatially apart each other, the concaved portion 130 and the specific wall portion 132 is positioned over the vibration member 2 as illustrated in FIG. 21.

Because the specific wall portion 132, having a greater structural compliance, is provided between the nozzle 4 and the flow restriction portion 7, a resonance may occur between the nozzle 4 and the specific wall portion 132 in the pressure chamber 6, thereby a resonance cycle in the pressure chamber 6 can be set shorter, and the liquid dispensing head 100*g* can dispense droplets with a higher frequency or higher responsiveness. Such liquid dispenser head 100*g* may have a similar effect described in the above exemplary embodiments.

Figure 22:
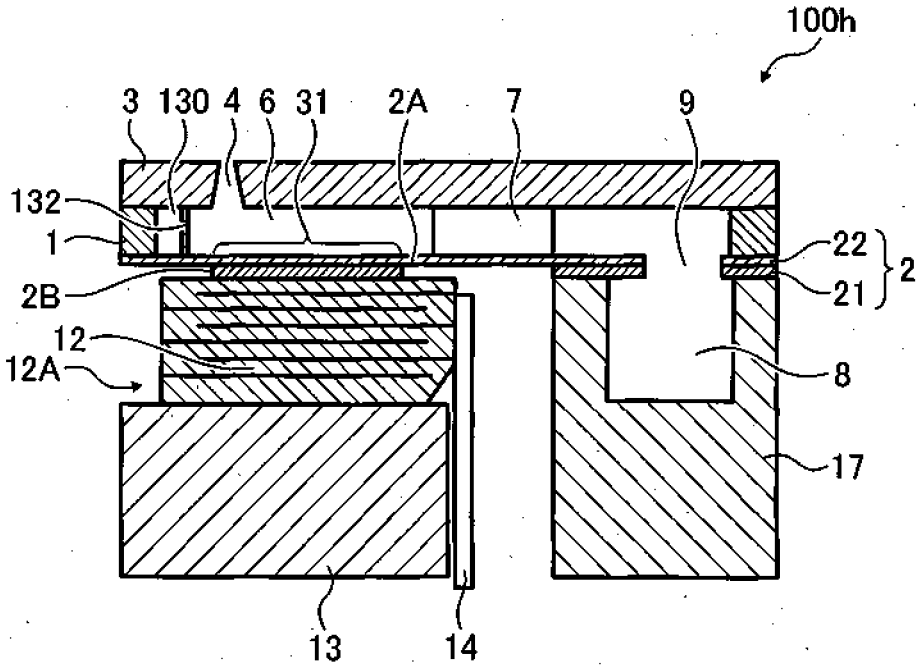
FIG. 22 shows a cross-sectional view of another liquid dispenser head according to another exemplary embodiment.

A description is now given to another liquid dispenser head according to another exemplary embodiment with reference to FIG. 22. FIG. 22 shows a cross-sectional view of a liquid dispenser head 100*h* according to another exemplary embodiment. In FIG. 22, the base plate 1 includes the concaved portion 130 and the specific wall portion 132 made of polyimide film, in which the specific wall portion 132 may extend between the vibration member 2 and the nozzle plate 3. In other words, the specific wall portion 132 may intersect with the vibration member 2 in FIG. 22.

Accordingly, the specific wall portion 132, having a structural compliance greater than a compression compliance of the liquid, is formed in the pressure chamber 6. Accordingly, the liquid dispenser head 100*h* may have a similar effect described in the above exemplary embodiments. Such specific wall portion 132 may have a thinner thickness as similar to the above-described specific wall portions 32 and 32A.

As above described, the liquid dispenser heads according to exemplary embodiments may have simpler configuration compared to conventional arts that may enhance a dispensing performance of a liquid dispenser head by using a rigidity-increased part or a rigidity-increased configuration.

Furthermore, because a resonance cycle of a pressure chamber of the liquid dispenser heads according to exemplary embodiments can be shortened as above described, the liquid dispenser heads can dispense droplets at higher frequency.

Furthermore, a liquid dispensing unit employing the liquid dispenser head according to the above exemplary embodiments can be configured, and an image forming apparatus employing such liquid dispenser head or liquid dispensing unit according to the above exemplary embodiments can be configured, by which an image having higher quality or higher density can be produced with a higher printing speed with the liquid dispensing unit or the image forming apparatus.

Figure 23:
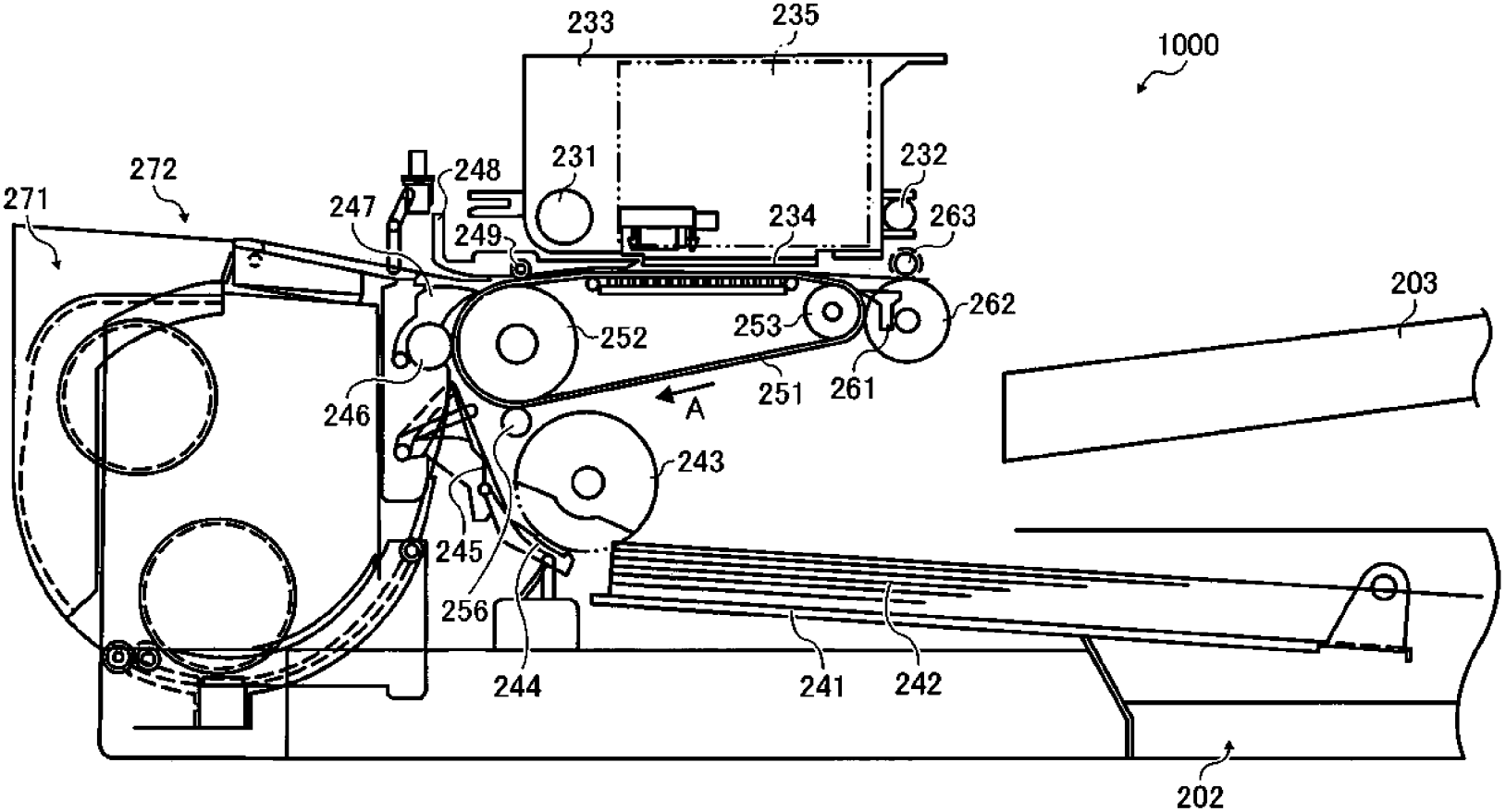
FIG. 23 shows a schematic configuration of an image forming apparatus according to an exemplary embodiment.
Figure 24:
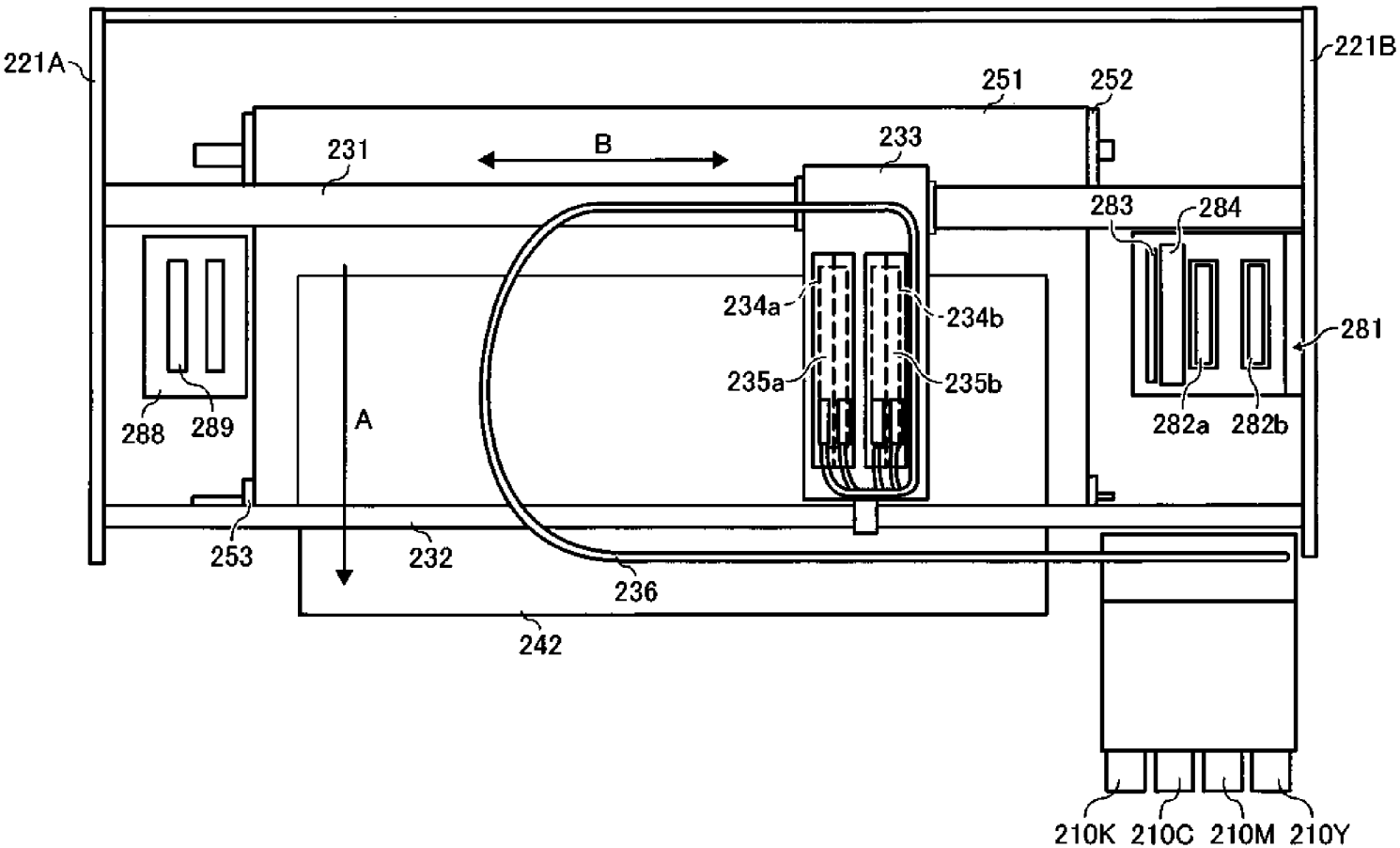
FIG. 24 shows a plan view of an image forming section in the image forming apparatus of FIG. 23.

A description is now given to an image forming apparatus having a liquid dispensing unit according to exemplary embodiment with reference to FIGS. 23 and 24.

FIG. 23 is a schematic configuration of an image forming apparatus 1000 according to an exemplary embodiment, and FIG. 24 is a plan view of a recording section of the image forming apparatus 1000. The image forming apparatus 1000 may be a serial type, which produces one line image step by step.

As illustrated in FIGS. 23 and 24, the image forming apparatus 1000 includes guide rods 231 and 232 extending between side plates 221A and 221B of the image forming apparatus 1000. A carriage 233 can be moved in a main scanning direction in the image forming apparatus 1000 with a guide of the guide rods 231 and 232. Specifically, the carriage 233 can slidably move in a main scanning direction shown by an arrow B in FIG. 24 with dive power of a motor and a timing belt (not illustrated).

As illustrated in FIG. 24, the carriage 233 includes recording heads 234*a* and 234*b* according to exemplary embodiments for discharging droplets of recording liquid (e.g., ink) of yellow (Y), cyan (c), magenta (M), and black (K). The recording heads 234*a* and 234*b* may be collectively referred as recording head 234.

The recording head 234 includes a plurality of nozzles for discharging droplets of recording liquid (e.g., ink), wherein such plurality of nozzles are arranged in one direction perpendicular to a main scanning direction of a recoding medium, and may dispense droplets in a downward direction in FIG. 23.

As illustrated in FIG. 24, the recording head 234*a* is provided with two nozzle arrays, in which one nozzle array dispenses recording liquid of black (K) and other nozzle array dispenses recording liquid of cyan (c), for example. Similarly, the recording head 234*b* is provided with two nozzle arrays, in which one nozzle array dispenses recording liquid of magenta (M) and other nozzle array dispenses recording liquid of yellow (Y), for example.

As illustrated in FIG. 24, the carriage 233 includes sub-tanks 235*a* and 235*b* for supplying recording liquid (e.g., ink) of different colors to each of the recording heads 234*a* and 234*b*. The sub-tank 235 can be connected to a main tank 210 (210K, 210C, 210M, 210Y) such as ink cartridge via a supply tube 236 so that the recording liquid (e.g., ink) can be supplied to the sub-tank 235 from the main tank 210.

As illustrated in FIG. 23, a sheet feed section includes a sheet cassette 202, a sheet stacking tray 241, a sheet 242, a sheet feed roller 243 shaped in half-moon, and a separation pad 244 made of material having a relatively greater friction coefficient, in which the separation pad 244 is biased toward the sheet feed roller 243.

The sheet feed roller 243 and the separation pad 244, which face each other, are used to feed the sheet 242 one by one to a transport section, to be described later, from the sheet stacking tray 241. As illustrated in FIG. 23, a plurality of sheets (i.e., sheet 242) can be stacked on the sheet stacking tray 241 of the sheet cassette 202.

As illustrated in FIG. 23, the transport section includes a transport belt 251, a guide 245, a counter roller 246, a transport guide 247, a press member 248, a pressure roller 249, and a charge roller 256. Such transport section is used to transport the sheet 242 from the sheet feed section to a recording section in the image forming apparatus 1000.

As illustrated in FIG. 23, the transport belt 251 of endless type is extended by a transport roller 252 and a tension roller 253, and such transport belt 251 travels in one direction to feed the sheet 242 to the recording section. The charge roller 256 can charge the transport belt 251 so that a surface of transport belt 251 can electro-statically adhere the sheet 242 thereon and transport the sheet 242 to the recording section. The transport roller 252, which is rotated by a motor (not illustrated), is used to travel the transport belt 251 in one direction.

After printing an image on the sheet 242 with the recording head 234, the sheet 242 is ejected to an ejection tray 203 with an ejection unit. Such ejection unit includes a separation claw 261, and ejection rollers 262 and 263. After forming an image on the sheet 242, the separation claw 261 separates the sheet 242 from the transport belt 251, and the sheet 242 is ejected to the ejection tray 203 by the ejection rollers 262 and 263.

The image forming apparatus 1000 further includes a sheet-inverting unit 271 on a rear side of the image forming apparatus 1000 as illustrated in FIG. 23, wherein the sheet-inverting unit 271 may be detachable from the image forming apparatus 1000 and may have a manual feed tray 272.

The sheet-inverting unit 271 receives the sheet 242 from the transport belt 251 when the transport belt 251 travels in a direction opposite to the direction shown by an arrow A, and inverts faces of the sheet 242. Then, the sheet-inverting unit 271 feeds the face-inverted sheet 242 to a space between the counter roller 246 and the transport belt 251.

Furthermore, as illustrated in FIG. 24, a refreshing unit 281 is provided on one end side of the image forming apparatus 1000, wherein the refreshing unit 281 is used to maintain a nozzle condition and to refresh the nozzle of the recording head 234.

As illustrated in FIG. 24, the refreshing unit 281 includes capping members 282*a* and 282*b*, a wiping blade 283, a dummy discharge receiver 284, for example.

The capping members 282*a* and 282*b* are used for capping a nozzle face of the recording head 234, and the wiping blade 283 is used to wipe the nozzle face of the recording head 234.

The dummy discharge receiver 284 is used for receiving droplets when a dummy discharging operation is conducted, wherein the dummy discharging operation is conducted by discharging fresh recording liquid (e.g., ink) from the nozzle without actual printing, by which viscosity-increased ink adhered on the nozzle of the recording head 234 may be removed from the recording head 234.

The image forming apparatus 1000 further includes an ink recovery unit 288 having an opening 289, matched to a size of nozzle array of the recording head 234 as illustrated in FIG. 24. The ink recovery unit 288 is used to receive ink, which may be discharged during a dummy discharge of recording liquid while conducting image forming operation.

In the image forming apparatus 1000, the sheet feed section feeds the sheet 242 one by one to the transport section. Then, the sheet 242 is guided by the guide 245, and transported to the space between the counter roller 246 and the transport belt 251. Then, the sheet 242 is guided by the transport guide 247 and pressed to the transport belt 251 by the pressure roller 249.

During such sheet transportation, a positive voltage and negative voltage current are supplied to the charge roller 256 from a high voltage power source (not illustrated) alternately. Therefore, the transport belt 251 is alternately charged with positive and negative voltage, thereby positive voltage charged areas and negative voltage charged areas are formed on the transport belt 251 alternately.

When the sheet 242 is fed on such charged transport belt 251, the sheet 242 is electro-statically adhered on the transport belt 251, and is transported to the recording section with a traveling of the transport belt 251.

As illustrated in FIG. 24, the carriage 233 having the recording head 234 can be moved in a direction shown by an arrow B over the sheet 242.

The recording head 234 discharges droplets (e.g., ink) onto the sheet 242 to record one line image on the sheet 242 when the carriage 234 moves in a direction shown by an arrow B.

During an image forming operation, a transportation of the sheet 12 is stopped for recording one line image on the sheet 242. When the recording of one line image completes, the sheet 242 is transported for a given distance and another one line image is recorded on the sheet 242 by discharging droplets (e.g., ink) onto the sheet 242. Such recording process is repeated for one page. When such recording operation completes for one page, the sheet 242 is ejected to the ejection tray 203.

Such image forming apparatus 1000 of serial type having a liquid dispenser head or liquid dispensing unit according to exemplary embodiments can produce an higher quality image with a higher speed because a liquid dispenser head or liquid dispensing unit according to exemplary embodiments can reliably dispense recording liquid.

Figure 25:
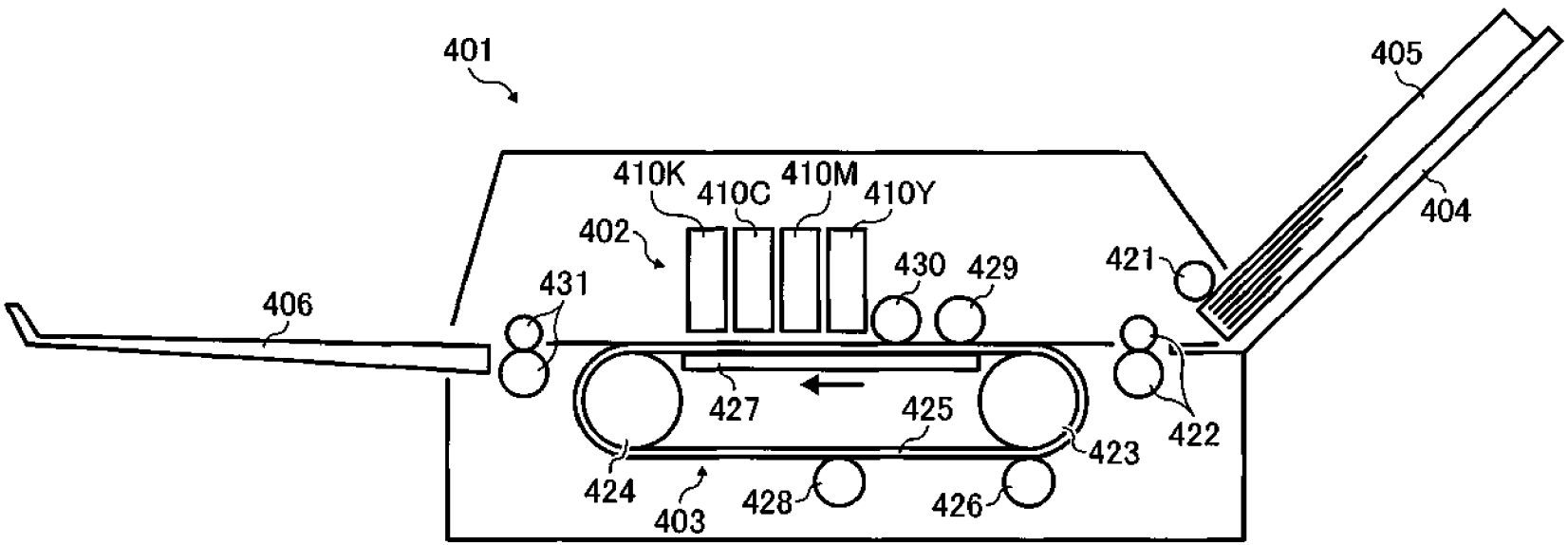
FIG. 25 shows a schematic configuration of another image forming apparatus according to another exemplary embodiment.

A description is now given to an image forming apparatus having a liquid dispenser head or a liquid dispensing unit according to exemplary embodiments with reference to FIG. 25.

FIG. 25 is a schematic view illustrating a configuration of an image forming apparatus 401 having a liquid dispensing unit according to exemplary embodiments. The image forming apparatus 401 may be a line type having a line head for the liquid dispensing unit, in which one-line image is produced by single dispensing operation from the line head because the line head has a width matched to a sheet width.

The image forming apparatus 401 includes an image forming section 402, a transport unit 403, a sheet feed tray 404, and a sheet ejection tray 406, for example. Sheet 405 stacked on the sheet feed tray 404 is transported to the image forming section 402 by the transport unit 403, then recorded with an image in the image forming section 402, and is ejected to the sheet ejection tray 406.

The image forming section 402 includes line head units 410Y, 410M, 410C, and 410K, held by a head holder (not illustrated). Each of the line head units 410Y, 410M, 410C, and 410K may be integrated with a tank for storing recording liquid, and has a nozzle array having a length matched to a sheet width, which is a in a direction perpendicular to a sheet transport direction.

Each of the line head units 410Y, 410M, 410C, and 410K dispenses recording liquid of yellow, magenta, cyan, and black, respectively, onto the sheet 405. Alternatively, such line head units 410Y, 410M, 410C, and 410K may not be integrated with a tank for storing recording liquid.

The sheet 405 on the sheet feed tray 404 is separated one by one by a separation roller 421, and fed to the transport unit 403 by a feed roller 422.

The transport unit 403 includes a transport belt 425, a charge roller 426, a guide plate 427, a cleaning roller 428, a de-charge roller 429, and a pressure roller 430, for example.

In the transport unit 403, the transport belt 425, extended by a drive roller 423 and a driven roller 424, is charged by the charge roller 426. The guide plate 427 supports the transport belt 425 in the image forming section 402. The cleaning roller 428, made of porous material, removes recording liquid (e.g., ink) adhered on the transport belt 425. The de-charge roller 429, mainly made of conductive rubber, de-charges the sheet 405. The pressure roller 430 presses the sheet 405 to the transport belt 425.

The sheet 405 having a recorded image thereon is ejected to the sheet ejection tray 406 by an ejection roller 431, provided at a sheet exit side of the transport unit 403.

As such, in the image forming apparatus 401 having line head units, the sheet 405 fed and adhered on the transport belt 425 is recorded with an image in the image forming section 402 while transported in one direction with a traveling of the transport belt 425, and ejected to the sheet ejection tray 406 after forming an image on the sheet 405.

Such image forming apparatus 401 having a liquid dispenser head or liquid dispensing unit according to exemplary embodiments can produce an higher quality image with a higher speed because a liquid dispenser head or liquid dispensing unit according to exemplary embodiments can reliably dispense recording liquid.

The above-described liquid dispensing unit and image forming apparatus according to exemplary embodiments can be applied to a printer, a facsimile, a copier or a multifunctional apparatus having printer/facsimile/copier function. Furthermore, the above-described liquid dispensing unit can be applied to any apparatus, which dispenses liquid other than ink.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined with each other and/or substituted for each other within the scope of this disclosure and appended claims.

This application claims priority from Japanese Patent Applications Nos. 2006-305395 and 2007-266977, filed on Nov. 10, 2006 and Oct. 12, 2007, respectively, in the Japan Patent Office, the entire contents of each of which are incorporated herein by reference.

What is claimed is:

1. A liquid dispenser head, comprising:

a plurality of nozzles configured to discharge liquid;

a plurality of pressure chambers, each one of the plurality of pressure chambers being configured to communicate with a corresponding one of the plurality of nozzles;

an energy generator provided for said each one of the plurality of pressure chambers, and configured to generate energy for pressurizing liquid in said each one of the plurality of pressure chambers;

a shared chamber configured to supply liquid to the plurality of pressure chamber;

a vibration member forming at least one of plural walls of said each one of the plurality of the pressure chambers, and including an energy-transmitting area configured to transmit the energy generated by the energy generator to each one of the plurality of the pressure chambers; and a specific wall portion locally positioned between the shared chamber and the energy-transmitting area, and constituting a part of a wall of said each one of the plurality of pressure chambers, the wall including first and second wall portions in addition to the specific wall portion, the first and second wall portions and the specific wall portion collectively forming a planar surface of the wall, the specific wall portion being interposed between the first and second wall portions, and the specific wall portion being configured to have a structural compliance set greater than a compression compliance of liquid in said each one of the plurality of pressure chambers.

2. The liquid dispenser head according to claim 1, wherein the specific wall portion has a first side length along a flow direction of liquid in the pressure chamber, and a second side length in a direction perpendicular to the flow direction of liquid, and the first side length is set greater than one half of the second side length.

3. The liquid dispenser head according to claim 2, wherein the first side length is set greater than the second side length.

4. The liquid dispenser head according to claim 1, wherein the vibration member includes a vibration portion around the energy-transmitting area, and the specific wall portion has a substantially same thickness as that of the vibration portion.

5. The liquid dispenser head according to claim 4, wherein the specific wall portion is disposed adjacent to the vibration portion of the vibration member.

6. The liquid dispenser head according to claim 1, wherein the vibration member includes a vibration portion around the energy-transmitting area, and the specific wall portion is disposed independently from the vibration portion of the vibration member.

7. The liquid dispenser head according to claim 1, wherein the vibration member is configured with a resin layer and a metal layer stacked over each other.

8. The liquid dispenser head according to claim 1, further comprising a flow restriction portion having a greater flow resistance than the pressure chamber, the flow restriction portion being provided between the shared chamber and each of the plurality of pressure chambers, and wherein the specific wall portion is provided between the shared chamber and the flow restriction portion.

9. A liquid dispenser head comprising:

a plurality of nozzles configured to discharge liquid;

a plurality of pressure chambers, each one of the plurality of pressure chambers being configured to communicate with a corresponding one of the plurality of nozzles;

an energy generator provided for said each one of the plurality of pressure chambers, and configured to generate energy for pressurizing liquid in said each one of the plurality of pressure chambers;

a shared chamber configured to supply liquid to the plurality of pressure chamber;

a vibration member forming at least one of plural walls of said each one of the plurality of the pressure chambers, and including an energy-transmitting area configured to transmit the energy generated by the energy generator to each one of the plurality of the pressure chambers; and a specific wall portion constituting a part of a wall of said each one of the plurality of pressure chambers, the specific wall portion having a structural compliance set greater than a compression compliance of liquid in the pressure chamber, wherein the specific wall portion is provided on a given wall position of the pressure chamber, and the given wall position faces over the vibration member.

10. The liquid dispenser head according to claim 9, wherein the specific wall portion faces over an area of the vibration member, between the energy-transmitting area and the shared chamber.

11. A liquid dispenser head, comprising:

a plurality of nozzles configured to discharge liquid;

a plurality of pressure chambers, each one of the plurality of pressure chambers being configured to communicate with a corresponding one of the plurality of nozzles;

an energy generator provided for said each one of the plurality of pressure chambers, and configured to generate energy for pressurizing liquid in said each one of the plurality of pressure chambers;

a shared chamber configured to supply liquid to the plurality of pressure chamber;

a vibration member forming a first wall of said each one of the plurality of the pressure chambers, and including an energy-transmitting area configured to transmit the energy generated by the energy generator to each one of the plurality of the pressure chambers; and a specific wall portion constituting at least a part of the first wall or a second wall of said each one of the plurality of pressure chambers, the specific wall portion having a structural compliance set greater than a compression compliance of liquid in said each one of the plurality of pressure chambers wherein the specific wall portion is provided on a given wall position of the pressure chamber, and the given wall position intersects the vibration member.

12. An image forming apparatus, comprising:

a liquid dispenser head, including:

a plurality of nozzles configured to discharge liquid;

a plurality of pressure chambers, each one of the plurality of pressure chambers being configured to communicate with a corresponding one of the plurality of nozzles;

an energy generator provided for said each one of the plurality of pressure chambers, and configured to generate energy for pressurizing liquid in said each one of the plurality of pressure chambers;

a shared chamber configured to supply liquid to the plurality of pressure chamber; and a vibration member configured as at least one of plural walls of said each one of the plurality of the pressure chambers, and including an energy-transmitting area configured to transmit the energy generated by the energy generator to each one of the plurality of the pressure chambers; and a specific wall portion positioned between the shared chamber and the energy-transmitting area, and constituting a part of a wall of said each one of the plurality of pressure chambers, the wall including first and second wall portions in addition to the specific wall portion, the first and second wall portions and the specific wall portion collectively forming a planar surface of the wall, the specific wall portion being interposed between the first and second wall portions, and the specific wall portion being configured to have a structural compliance set greater than a compression compliance of liquid in said each one of the plurality of pressure chambers.

13. The image forming apparatus of claim 12, wherein the specific wall portion has a first side length along a flow direction of liquid in the pressure chamber, and a second side length in a direction perpendicular to the flow direction of liquid, and the first side length is set greater than one half of the second side length.

14. The image forming apparatus of claim 13, wherein the first side length is set greater than the second side length.

15. The image forming apparatus of claim 12, wherein the vibration member includes a vibration portion around the energy-transmitting area, the specific wall portion has a substantially same thickness as that of the vibration portion and is disposed adjacent to the vibration portion of the vibration member.

16. The image forming apparatus of claim 12, wherein the vibration member includes a vibration portion around the energy-transmitting area, and the specific wall portion is disposed independently from the vibration portion of the vibration member.

17. The image forming apparatus of claim 12, wherein the vibration member is configured with a resin layer and a metal layer stacked over each other.

18. The image forming apparatus of claim 12, wherein the liquid dispenser head further comprises a flow restriction portion having a greater flow resistance than the pressure chamber, the flow restriction portion being provided between the shared chamber and each of the plurality of pressure chambers, and wherein the specific wall portion is provided between the shared chamber and the flow restriction portion.

* * * * *